US006609845B1

(12) United States Patent
Ninomiya

(10) Patent No.: US 6,609,845 B1
(45) Date of Patent: Aug. 26, 2003

(54) PRINTING APPARATUS AND IMAGE DATA PROCESSING METHOD THEREFOR

(75) Inventor: Takayuki Ninomiya, Ichikawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/619,666

(22) Filed: Jul. 19, 2000

(30) Foreign Application Priority Data

Jul. 19, 1999 (JP) ..... 11-204958

(51) Int. Cl.[7] ..... B41J 11/00

(52) U.S. Cl. ..... 400/124.08; 400/124.11; 400/124.2; 400/120.17; 400/416.1; 347/20; 347/43; 347/23

(58) Field of Search ..... 400/124.08, 124.09, 400/124.11, 124.2, 582, 583, 579, 120.17, 416.1; 347/20, 43, 23, 42

(56) References Cited

U.S. PATENT DOCUMENTS

| | | | | |
|---|---|---|---|---|
| 4,313,124 A | | 1/1982 | Hara | |
| 4,345,262 A | | 8/1982 | Shirato et al. | |
| 4,459,600 A | | 7/1984 | Sato et al. | |
| 4,463,359 A | | 7/1984 | Ayata et al. | |
| 4,558,333 A | | 12/1985 | Sugitani et al. | |
| 4,608,577 A | | 8/1986 | Hori | |
| 4,723,129 A | | 2/1988 | Endo et al. | |
| 4,740,796 A | | 4/1988 | Endo et al. | |
| 5,774,153 A | * | 6/1998 | Kuehnle et al. | 347/129 |
| 5,805,735 A | * | 9/1998 | Chen et al. | 382/239 |
| 6,007,195 A | * | 12/1999 | Kokubo | 347/108 |
| 6,042,213 A | * | 3/2000 | Hayasaki | 347/19 |
| 6,049,390 A | * | 4/2000 | Notredame et al. | 358/1.15 |
| 6,070,963 A | | 6/2000 | Kamada et al. | |
| 6,128,103 A | | 10/2000 | Kawamura | |
| 6,158,905 A | * | 12/2000 | Endo | 400/76 |
| 6,164,746 A | | 12/2000 | Akahira et al. | |
| 6,264,295 B1 | * | 7/2001 | Bernegger et al. | 347/2 |
| 6,272,252 B1 | * | 8/2001 | Eldridge et al. | 382/232 |
| 6,273,549 B1 | * | 8/2001 | Wetchler et al. | 347/43 |
| 6,360,656 B2 | * | 3/2002 | Kubo et al. | 101/35 |

FOREIGN PATENT DOCUMENTS

| | | |
|---|---|---|
| EP | 0 832 745 | 4/1998 |
| JP | 54-56847 | 5/1979 |
| JP | 59-123670 | 7/1984 |
| JP | 59-138461 | 8/1984 |
| JP | 60-71260 | 4/1985 |
| JP | 7-115553 | 5/1995 |

* cited by examiner

*Primary Examiner*—Andrew H. Hirshfeld
*Assistant Examiner*—Darius N. Cone
(74) *Attorney, Agent, or Firm*—Fitzpatrick, Cella, Harper & Scinto

(57) ABSTRACT

A printing apparatus, which performs printing by using a full-line type printhead, prints an image in accordance with an attachment angle of the printhead, and automatically performs registration adjustment when using plural printheads. In the apparatus, an angle of the printhead relative to a transfer direction of a print medium is detected, image data received in raster format is divided into plural pixel blocks, the divided pixel blocks are stored into a memory, the order of reading the pixel blocks from the memory is determined based on the detected relative angle, and the read data is transmitted to the printhead and used for printing.

13 Claims, 23 Drawing Sheets

| | BLOCK1 | BLOCK2 | BLOCK3 | BLOCK4 |
|---|---|---|---|---|
| RASTER1 | 1-1 | 1-2 | 1-3 | 1-4 |
| RASTER2 | 2-1 | 2-2 | 2-3 | 2-4 |
| RASTER3 | 3-1 | 3-2 | 3-3 | 3-4 |
| RASTER4 | 4-1 | 4-2 | 4-3 | 4-4 |
| RASTER5 | 5-1 | 5-2 | 5-3 | 5-4 |
| RASTER6 | 6-1 | 6-2 | 6-3 | 6-4 |
| RASTER7 | 7-1 | 7-2 | 7-3 | 7-4 |
| RASTER8 | 8-1 | 8-2 | 8-3 | 8-4 |

FIG. 4

| EVENT | 1 | 2 | 3 | 4 | 5 | 6 |
|---|---|---|---|---|---|---|
| RAM ADDRESS | (W)TABLE ADDRESS [m,n] | (W)PIXEL ADDRESS [m,n,1] | (W)PIXEL ADDRESS [m,n,2] | (R)PIXEL ADDRESS [i,j,k] | (R)TABLE ADDRESS [i,j+1] | (R)PIXEL ADDRESS [i,j+1,1] |
| DATA | (W)PIXEL ADDRESS [m,n,1] | (W)PIXEL DATA [m,n,1] | (W)PIXEL DATA [m,n,2] | (R)PIXEL DATA [i,j,k] | (R)PIXEL ADDRESS [i,j+1,1] | (R)PIXEL DATA [i,j+1,1] |
| Read/Write | W | W | W | R | R | R |
| STATUS | WRITE START ADDRESS OF [m,n] PIXEL DATA | WRITE [m,n] FIRST DATA | WRITE [m,n] SECOND DATA | READ [i,j] k-TH DATA | READ START ADDRESS OF [i,j+1] PIXEL DATA | READ [i,j+1] FIRST DATA |

FIG. 5

| EVENT | 1 | 2 | 3 | 4 | 5 | 6 |
|---|---|---|---|---|---|---|
| RAM ADDRESS | (R)TABLE ADDRESS [1,1] | (R)TABLE ADDRESS [1-1,2] | (R)TABLE ADDRESS [1-2,3] | (R)TABLE ADDRESS [1-3,4] | (R)PIXEL ADDRESS [1,1,1] | (R)PIXEL ADDRESS [1,1,2] |
| DATA | | | (R)PIXEL DATA [1,1,1] | (R)PIXEL ADDRESS [1-1,2,1] | (R)PIXEL ADDRESS [1-2,3,1] | (R)PIXEL ADDRESS [1-3,4,1] |
| Read/Write | R | R | R | R | R | R |
| ADDRESS STATUS | READ START ADDRESS OF [1,1] PIXEL DATA | READ START ADDRESS OF [1-1,2] PIXEL DATA | READ START ADDRESS OF [1-2,3] PIXEL DATA | READ START ADDRESS OF [1-3,4] PIXEL DATA | READ [1,1] FIRST DATA | READ [1,1] SECOND DATA |
| DATA STATUS | | | READ START ADDRESS OF [1,1] PIXEL DATA | READ START ADDRESS OF [1-1,2] PIXEL DATA | READ START ADDRESS OF [1-2,3] PIXEL DATA | READ START ADDRESS OF [1-3,4] PIXEL DATA |

PRINTING APPARATUS AND IMAGE DATA PROCESSING METHOD THEREFOR

FIELD OF THE INVENTION

The present invention relates to a printing apparatus and an image data processing method of the printing apparatus, and more particularly, to image data processing in a printing apparatus which performs printing by using a full-line type printhead.

BACKGROUND OF THE INVENTION

A printing apparatus which performs printing based on information on desired characters, images and the like on a sheet-type print medium such as print paper or a film is widely used as an information output device in a word processor, a personal computer, a facsimile machine and the like. Further, a printing apparatus which performs high-speed printing using a so-called full-line type printhead while conveying a print medium is known as this type of apparatus. The printhead has a printing area, corresponding to the width of printing area of print medium such as a print sheet, in a direction vertical to a transfer direction of the print medium.

An ink-jet type line head, an electrophotographic LED line head and the like are known as such full-line type printheads of the printing apparatus. A color page printer using plural such printheads, an electrophotographic page printer using laser light and the like are known.

Conventionally well-known problems include, when a color image is formed by using plural full-line type printheads, printing positions of respective colors are shifted due to attachment errors and the like of the respective printheads. As an example, an electrophotographic color page printer will be described. This color printer has four types of printheads, a black printhead, a cyan printhead, a magenta printhead and a yellow printhead. Upon printing with these printheads, registration adjustment is necessary.

Japanese Published Unexamined Patent Application No. Hei 07-115553 discloses such registration adjustment method. In this method, registration adjustment is made in printing by dividing image data into arbitrary image blocks, then in reading, time-divisionally changing pixel reading positions in each image block.

However, in the block-based processing as disclosed in the above publication, image data cannot be written into a memory before all the data for at least one pixel block is prepared. Accordingly, in a line-sequential image processing system to process image data continuous in a main scanning direction (raster data), the amount of data in the main scanning direction increases, and a memory capacity in proportion to the amount of data is required.

Especially, in data coding in pixel block units, it is necessary to store all the data for 1 pixel block. Further, as described in Japanese Published Unexamined Patent Application No. Hei 07-115553, upon data coding, if some data drop due to compression/expansion is allowable, coding to a fixed length code is possible; however, generally, in lossless coding in which data drop due to compression/expansion is not allowable, if a predetermined amount of pixel block is compressed, the amount of data is not fixed, and the amount of coded information differs in correspondence with the data status.

Accordingly, if conversion to fixed length code cannot be performed, the memory management method described in the above publication cannot be used.

SUMMARY OF THE INVENTION

The present invention has been made in consideration of the above situation, and can provide a printing apparatus capable of image printing in correspondence with an attachment angle of a full-line type printhead and capable of automatic registration adjustment when using plural printheads, and an image data processing method for the printing apparatus.

According to the present invention, the foregoing object is attained by providing a printing apparatus which performs printing by using a full-line type printhead having a printing area corresponding to a width of a printing area of a print medium, comprising: detection means, for detecting a relative angle of the printhead to a transfer direction of the print medium; division means for dividing image data, received in raster format, into plural pixel blocks; storage means for storing the divided pixel blocks; determination means for determining an order of reading/writing of the pixel blocks for the storage means, based on the relative angle detected by the detection means; and control means for performing the reading/writing of the pixel blocks for the storage means in the order determined by the determination means.

Further, the foregoing object is attained by providing an image data processing method for a printing apparatus which performs printing by using a full-line type printhead having a printing area corresponding to a width of a printing area of a print medium, comprising: a detection step of detecting a relative angle of the printhead to a transfer direction of the print medium; a division step of dividing image data, received in raster format, into plural pixel blocks; a storage step of storing the divided pixel blocks into storage means; a determination step of determining an order of reading/writing of the pixel blocks for the storage means, based on the relative angle detected at the detection step; and a control step of performing the reading/writing of the pixel blocks for the storage means in the order determined at the determination step.

That is, the relative angle of printhead with respect to the print-medium transfer direction is detected, then raster image data is divided into plural blocks and stored, then the order to read the stored plural blocks is determined in accordance with the detected relative angle, and the read data is transmitted to the printhead.

In this construction, as the pixel block data is transmitted to the printhead in the order corresponding to the attachment angle of the printhead, image data can be print-outputted always at the same angle regardless of the attachment angle of the printhead. Accordingly, upon color printing by using plural printheads, the influence of attachment errors, of the respective printheads can be reduced and the registration adjustment can be facilitated. Further, as the memory used as the storage means can be shared among the plural printheads, and various compression/expansion methods can be used in correspondence with image data type, the memory can be effectively used and the capacity can be reduced.

The present invention is applicable to a printing apparatus having plural printheads, wherein the respective printheads use different-color printing materials in color printing.

In this case, it is preferable that the storage means can be commonly used among the plural printheads.

Further, as the detection means, plural readers arrayed along the transfer direction of the print medium can be used, and image data corresponding to 1 raster printed by the printhead is read by the respective readers so as to detect the relative angle.

Further, if it is arranged such that the division means includes compression means for compressing image data, and the transmission means includes expansion means for expanding compressed image data, it is preferable that various compression/expansion methods can be used in accordance with image data type.

Preferably, the printhead is an ink-jet printhead which performs printing by discharging ink utilizing thermal energy or the like.

Other features and advantages of the present invention will be apparent from the following description taken in conjunction with the accompanying drawings, in which like reference characters designate the same name or similar parts throughout the figures thereof.

BRIEF DESCRIPTION OF THE DRAWINGS

The accompanying drawings, which are incorporated in and constitute a part of the specification, illustrate embodiments of the invention and, together with the description, serve to explain the principles of the invention.

FIG. 4 is a timing chart showing operations in a RAM control bus;

FIG. 5 is a timing chart showing operations in use of high-speed bus;

DETAILED DESCRIPTION OF THE PREFERRED EMBODIMENT

A preferred embodiment of the present invention will now be described in detail in accordance with the accompanying drawings.

Figure 21:
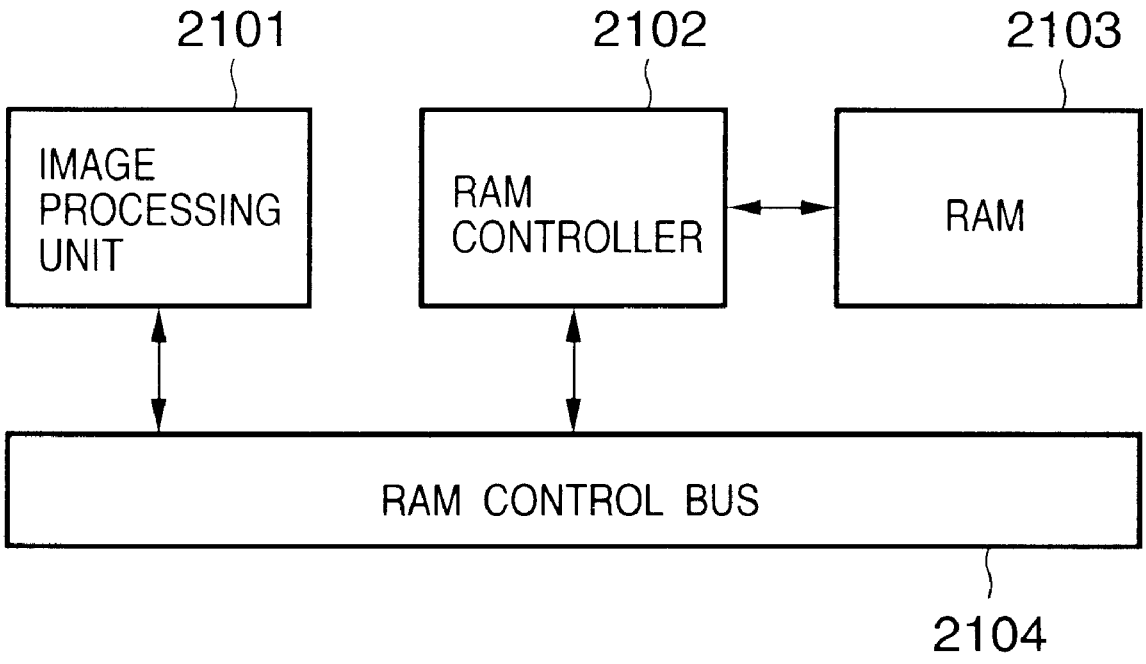
FIG. 21 is a block diagram showing the control construction of the printing apparatus having one printhead.

FIG. 21 is a block diagram showing the control construction of a printing apparatus according to an embodiment of the present invention. The printing apparatus of the present embodiment has one image processing unit 2101 connected to one printhead to perform monochrome printing.

Figure 1:
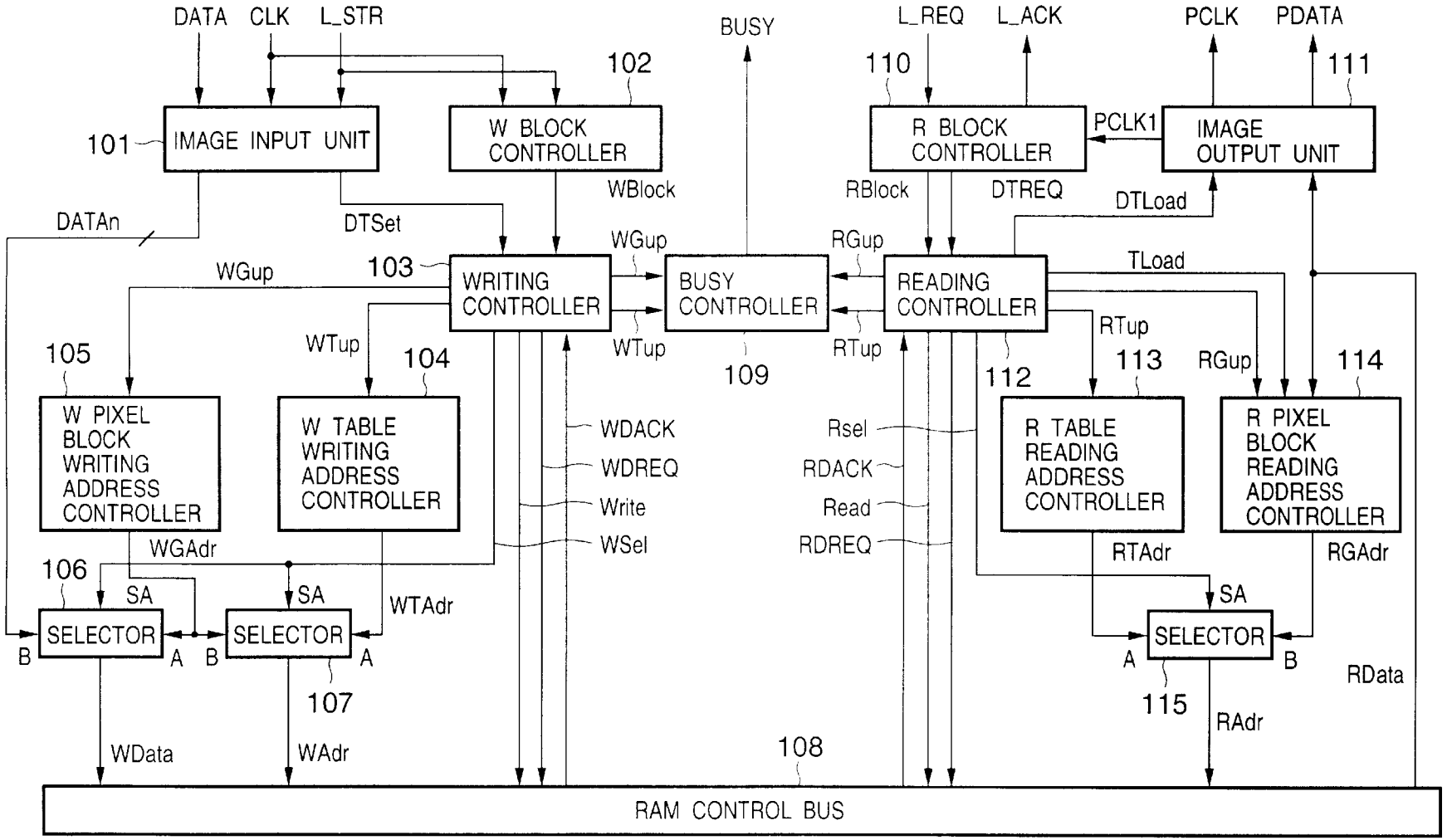
FIG. 1 is a block diagram showing the construction of an image processing unit of a printing apparatus according to an embodiment of the present invention.

The image processing unit 2101 has a construction as shown in FIG. 1 described below. Reading information is transmitted from the image processing unit 2101 via a RAM control bus 2104 to a RAM controller 2102. The RAM controller 2102 performs data transmission/reception with respect to a RAM 2103 directly connected to the RAM controller.

FIG. 1 is a block diagram showing the construction of the image processing unit according to the present embodiment. The image processing unit of the present embodiment has an image input unit 101, a W block controller 102, a writing controller 103, a W table writing address controller 104, a W pixel block writing address controller 105, selectors 106 and 107, a RAM control bus 108, a BUSY controller 109, an R block controller 110, an image output unit 111, a reading controller 112, an R table reading address controller 113, an R pixel block reading controller 114, and a selector 115.

An image data signal DATA is inputted into the image input unit 101 in synchronization with a clock signal CLK. A signal L_STR is a signal indicating raster data delimitation. When this signal is asserted, it is determined that data transferred after the assertion is the head of raster. After the assertion of the signal L_STR, a series of raster data is inputted into the image input unit 101 with the clock signal CLK.

The image input unit 101 converts the input image data into a signal DATAn with a data width appropriate to the RAM control bus 108 and outputs the signal upon completion of the conversion, the image input unit asserts a signal DTSet to notify the completion of the conversion.

In parallel with the processing by the image input unit 101, the W block controller 102 performs calculation to obtain pixel blocks. The W block controller 102 generates division information to divide the input image data into plural pixel blocks. That is, if it is determined that the head pixel of each pixel block has been inputted, the W block controller 102 asserts a signal WBlock, to indicate that input of image data as the head of new pixel block has been started.

In response to the assertion of the signals WBlock and DTSet, the writing controller 103 performs timing control for access to a RAM. In the present embodiment, DMA data hand shake is used as a RAM access method.

In the DMA data hand shake, when a unit requiring DMA has prepared address information and data information, it asserts a DMA request signal to a RAM control bus connected to a RAM controller (not shown). In response to the request, when data has been obtained from the RAM or data writing into the RAM has been completed, the RAM controller returns a DMA acknowledgment signal corresponding to the DMA request signal to the DMA requiring unit.

In the present embodiment, when the writing controller 103 receives the signal WBlock or DTSet, it asserts a writing DMA request signal WDREQ to the RAM controller while performing timing control inside. In this case, two types of DMA requests exist. The first request is made by assertion of the signal WBlock and the second request is made by assertion of the signal DTSet.

The first DMA request by the assertion of the signal WBlock is made, as described above, when it is determined that the head pixel of pixel block has been inputted, to indicate that input of the head image data of new pixel block has been started. In this case, first, address information to read the new pixel block information is stored into a memory. Since the information is a tag to read the pixel block, the data cannot be read without this information. For this reason, the writing controller 103 generates a DMA request to the RAM controller with the address for storing the next pixel block, as data, or as the next writing address in a table continuously holding the tags. The selection of the addresses and data information are made based on a signal WSel outputted by the writing controller 103.

Assuming that an area for storing the address information to read/write pixel block information is a table, the next writing/reading address within the table is a table address, information stored in the table is table information, and an initial address in the memory to write/read a new pixel block is a pixel block address, it can be considered that the pixel block address is stored as the table information.

The W table writing address controller 104 manages such table addresses. The controller calculates a table address for next writing, and outputs a signal WTAdr as the table address. Further, the W pixel block writing address controller 105 manages a pixel block address as the next pixel-block writing address, and outputs a signal WGAdr as the address.

The address information outputted from the two controllers are controlled by assertion of the signal WSel by the writing controller 103. That LS, by the assertion of the signal WSel, the selector 106 outputs the signal WTAdr to a signal WADr of the address information, and the selector 107 outputs the signal WGAdr to a signal WData of data information.

In this status, the writing controller 103 asserts the writing DMA request signal WDREQ to the RAM control bus 108. In response to the request, after completion of data writing, the RAM controller asserts a signal WDACK indicating the completion of DMA. This means that the head address of new pixel block has been written into the table.

After it is checked that the signal WDACK has been asserted, the writing controller 103 supplies a signal WTup as a trigger signal to start calculation of the next table address to the W table writing address controller 104. The W table writing address controller 104 checks the assertion of the signal Wtup, calculates the next table address, and upon completion of the calculation, outputs the signal WTAdr as the table address.

Next, the operation of the writing controller 103 by the assertion of the signal DTSet as the second DMA request will be described. In this case, the sequence is the same as that upon assertion of the signal WBlock as the first DMA request. The difference is the state of the signal WSel as a selector selection signal. In case of the second request, the signal WSel is in a negated state, then the signal WGAdr as the output signal from the W pixel block writing address controller 105 is outputted as address information to the RAM control bus 108, and the pixel data signal DATAn as an output from the image input unit 101 is outputted as data information.

In this status, the writing controller 103 asserts the signal WDREQ and notifies the RAM controller of the DMA request. The RAM controller writes pixel data in the pixel block address in accordance with the DMA, and after the completion of pixel data writing, asserts the signal WDACK to the writing controller 103. In response to the assertion of the signal WDACK, the writing controller 103 asserts a signal WGup to the W pixel block writing address controller 105. In response to the assertion of the signal WGup, the W pixel block writing address controller 105 calculates the next pixel-data writing address, then after the completion of the calculation, outputs the signal WGAdr as the pixel block address.

The above-described DMA request by the assertion of the signal DTSet is continuously performed until all the image data within the pixel block has been stored into the RAM. Further, the above sequence is performed for all the pixel blocks existing within one raster, and is completed when all the data within one raster has been stored into the RAM. Then, when the signal L_STR notifying transfer of the next raster data is asserted, the above processing is repeated.

Next, data reading sequence will be described. The image data written by the above writing sequence is read and transferred to the printhead by data request from the printhead. The image request from the printhead that performs an image based on raster data is performed in raster units, and a trigger signal of the image request is signal L_REQ.

When the signal L_REQ is asserted, the R block controller 110 generates an image data reading request to the reading controller 112. As described above, as the image data is divided into plural pixel blocks and stored in the memory, the first processing is reading address information of stored image data of pixel block. That is, the address information is stored into the memory indicated by the table address as table information.

The R table reading address controller 113, which manages the above table addresses, outputs a signal RTAdr as the next table address. The reading controller 112 asserts a signal RSel, and supplies the signal RTAdr as the output from the R table reading address controller 113 as the address information to the RAM control bus 108.

In this status, the reading controller 112 asserts a signal RDREQ, to cause the RAM controller to generate a memory reading DMA request via the RAM control bus. In response to the DMA request, the RAM controller asserts a signal RDACK while outputting the content of the RAM indicated by the above address information to a signal RData from the RAM control bus 108.

In response to the assertion of the signal RDACK, the reading controller 112 asserts a signal TLoad to the R pixel block reading address controller 114. The signal TLoad is used for storing the table address indicating the address of head image data of read pixel block into the R pixel block reading address controller 114. By the assertion of this signal, the signal RGAdr as an output signal from the R pixel block reading address controller 114 becomes a pixel block address as the initial address to read the pixel block in the memory.

In this status, the reading controller 112 negates the signal RSel for the selector 115, and supplies the signal RGAdr as the address information for the RAM control bus 108. As the pixel block address is designated as the address information, the signal RDREQ is asserted again by the reading controller 112.

In response to the assertion, the RAM controller reads data from the address indicated by the signal RADr, then outputs the data to the signal RData, and in this status, asserts the signal RDACK. At this time the first image data in the pixel block is outputted to the signal RData. In response to the assertion of the signal RDACK, the reading controller 112 asserts a signal DTLoad to the image output unit.

The image output unit stores the image data on the signal RData in synchronization with the assertion of the signal DTLoad. The stored image data is transferred from a signal PDATA to the printhead in synchronization with the signal PCLK.

The image output unit 111 outputs a signal PCLK1 to the R block controller 110 in synchronization with the output of image data. The signal PCLK1, which is asserted for one data of image data, is inputted into the R block controller 110, and used for raster management, pixel block management and number-of-data management.

The R block controller 110 determines existence/absence of untransferred pixel data by measuring the signal PCLK1. If there is untransferred pixel data, the R block controller 110 asserts a signal DTREQ as a reading trigger signal to the reading controller 112. Further, if image reading from a new pixel block is necessary, the R block controller 110 asserts a signal RBlock to require reading of the next pixel block.

When image data for one raster has been transferred by the series of sequence, the R block controller 110 outputs a signal L_ACK to the printhead, notifying the completion of transfer of one raster image data.

The BUSY controller 109 is provided between the reading controller 112 and the writing controller 103. The BUSY controller 109 monitors overwriting to the memory. The BUSY controller 109 measures the used table capacity and the used image data capacity, and when the respective capacities reach the maximum value of the memory capacity, outputs a signal BUSY. Image data input must be performed with checking the state of the BUSY signal.

Next, the respective elements in FIG. 1 will be described in detail with reference to FIGS. 6 to 18.

Figure 6:
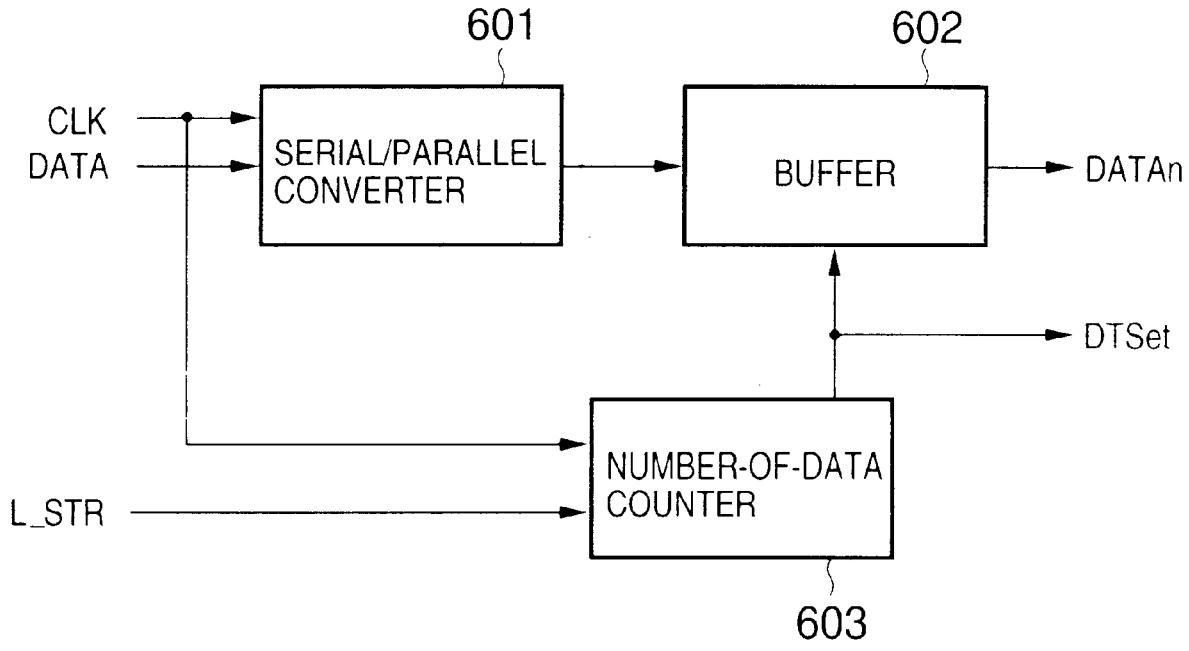
FIG. 6 is a block diagram showing the construction of an image input unit in FIG. 1.

FIG. 6 is a block diagram showing the construction of the image input unit 101. The image input unit 101 has a serial/parallel converter 601, a buffer 602 and a number-of-data counter 603.

The number-of-data counter 603 is initialized by the signal L_STR indicating the head of each raster, then the unit enters a data reception mode, in which image data DATA inputted in synchronization with the clock signal CLK is inputted into the serial/parallel converter 601 and is converted into parallel data. The number-of-data counter 603 outputs the signal DTSet when the data has been converted into the parallel data by the serial/parallel converter 601, to latch the parallel data in the buffer 602.

Figure 7:
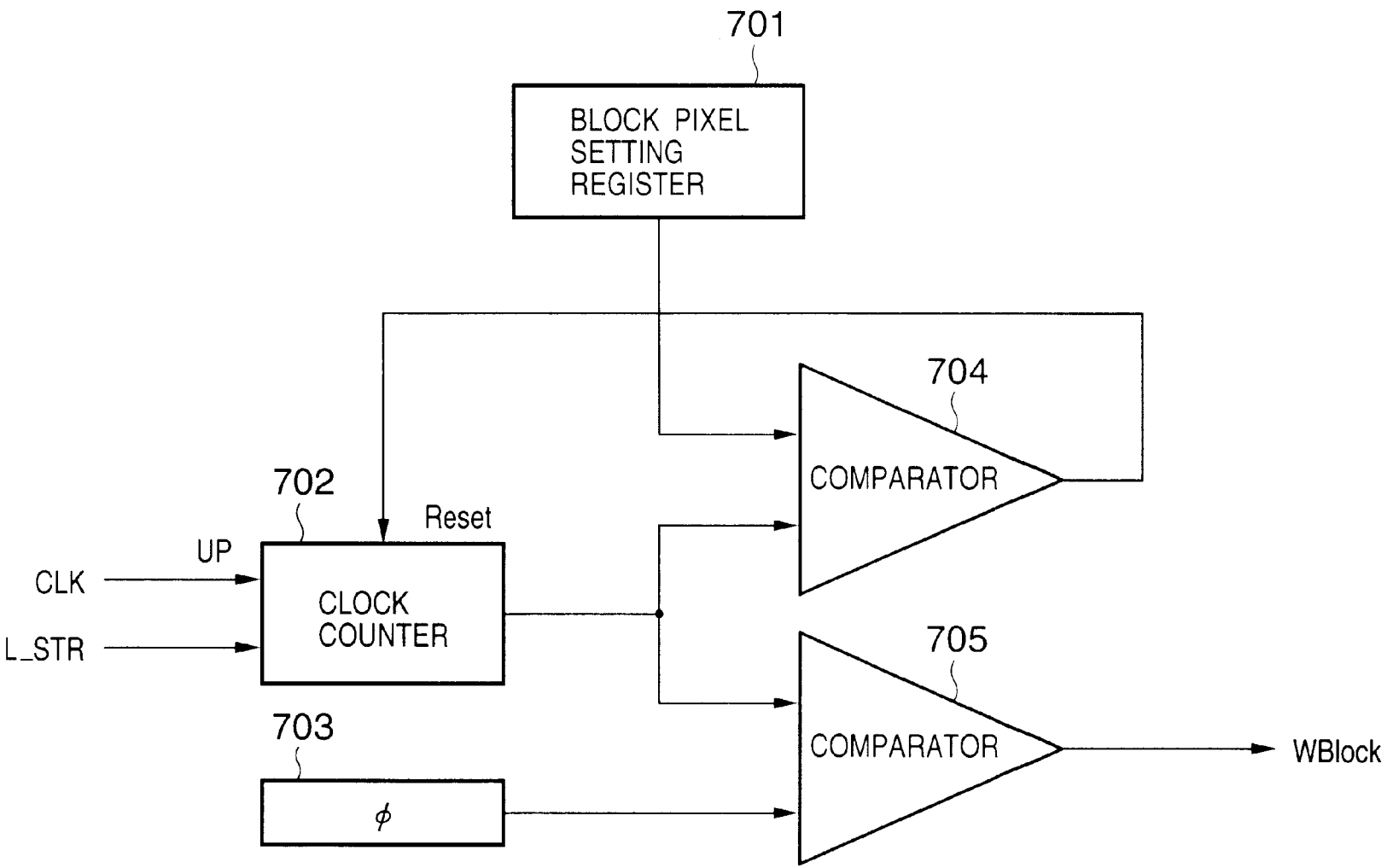
FIG. 7 is a block diagram showing the construction of a W block controller in FIG. 1.

FIG. 7 is a block diagram showing the construction of the W block controller 102. The W block controller 102 has a block pixel setting register 701, a clock counter 702, a gate 703 to output a level "0", and two comparators 704 and 705.

The clock counter 702 is initialized by the clock signal CLK and the signal L_STR indicating the head of each raster. Further, in the block pixel setting register 701 for setting the number of data within one pixel block, an appropriate value is set. When the clock counter 702 is initialized by the signal L_STR, the counter outputs "0", to assert the signal WBlock as an output signal from the comparator 705, to notify the outside of input of the initial data of the pixel block.

When the signal CLK is continuously inputted, the clock counter 702 is sequentially incremented. When the value of the clock counter 702 becomes equal to that of the block pixel setting register 701, the comparator 704 outputs a reset signal to the clock counter 702, thereby the output from the clock counter 702 becomes "0". This sequence is repeated, and the signal WBlock notifying dividing timing for the pixel block within 1 raster is outputted.

Figure 8:
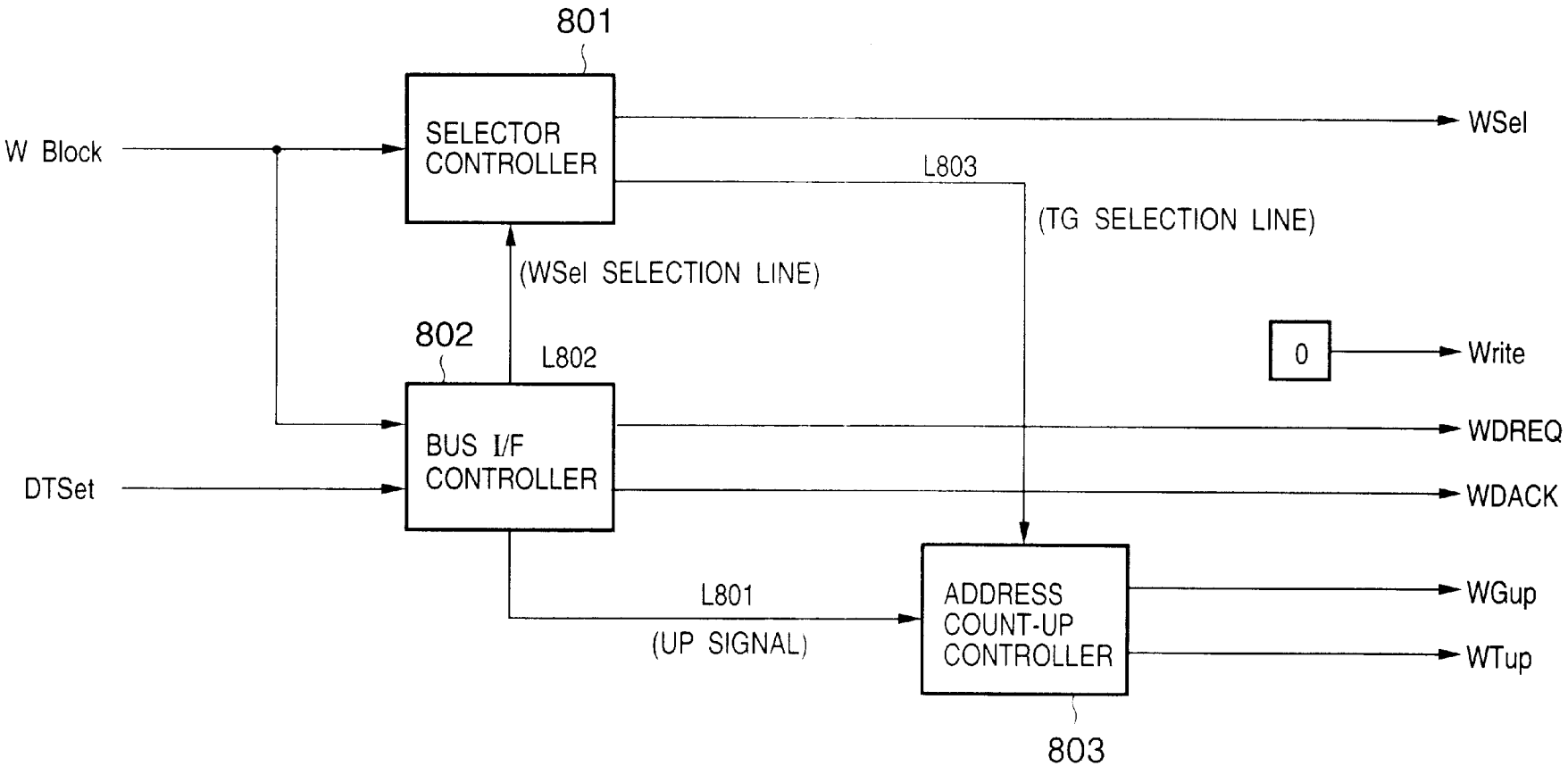
FIG. 8 is a block diagram showing the construction of a writing controller in FIG. 1.

FIG. 8 is a block diagram showing the construction of the writing controller 103. The writing controller 103 has a selector controller 801, a bus I/F controller 802 and an address count-up controller 803.

When the signal WBlock indicating the head of pixel block is inputted, the selector controller 801 asserts the signal WSel, and at the same time, asserts count-up selection line L803 to the address count-up controller 803. When an UP signal L801 is asserted while the count-up selection line signal L803 is in the asserted state, the signal WTup is asserted, and when the UP signal L801 is asserted while the count-up selection line L803 is in the negated state, the signal WGup is asserted.

Then, the bus I/F controller 802 asserts the signal WDREQ. On the other hand, when the signal WDACK is asserted, the bus I/F controller 802 negates the signal WDREQ, further, asserts the UP signal L801. In this status, if the UP signal is asserted, as the count up selection line L803 is in the asserted state, the signal WTup is asserted.

Thereafter, the bus I/F controller 802 asserts a line 802 to switch the signal WSel, to negate the signals WSel and L803. The sequence by the writing controller 103 in response to the assertion of the signal WBlock is as described above.

Next, the operation after the assertion of the signal DTSet will be described. When the signal DTSet is asserted, the bus I/F controller 802 asserts the signal WDREQ as in the case of the signal WBlock, then negates the signal WDREQ in response to the assertion of the signal WDACK, and at the same time, asserts the UP signal L801. At this time, as the count-up selection line L803 is in the negated state, the signal WGup is asserted. The signal WDREQ is a pulse signal to indicate a state. The assertion of the signal WDREQ means output of one pulse.

Figure 9:
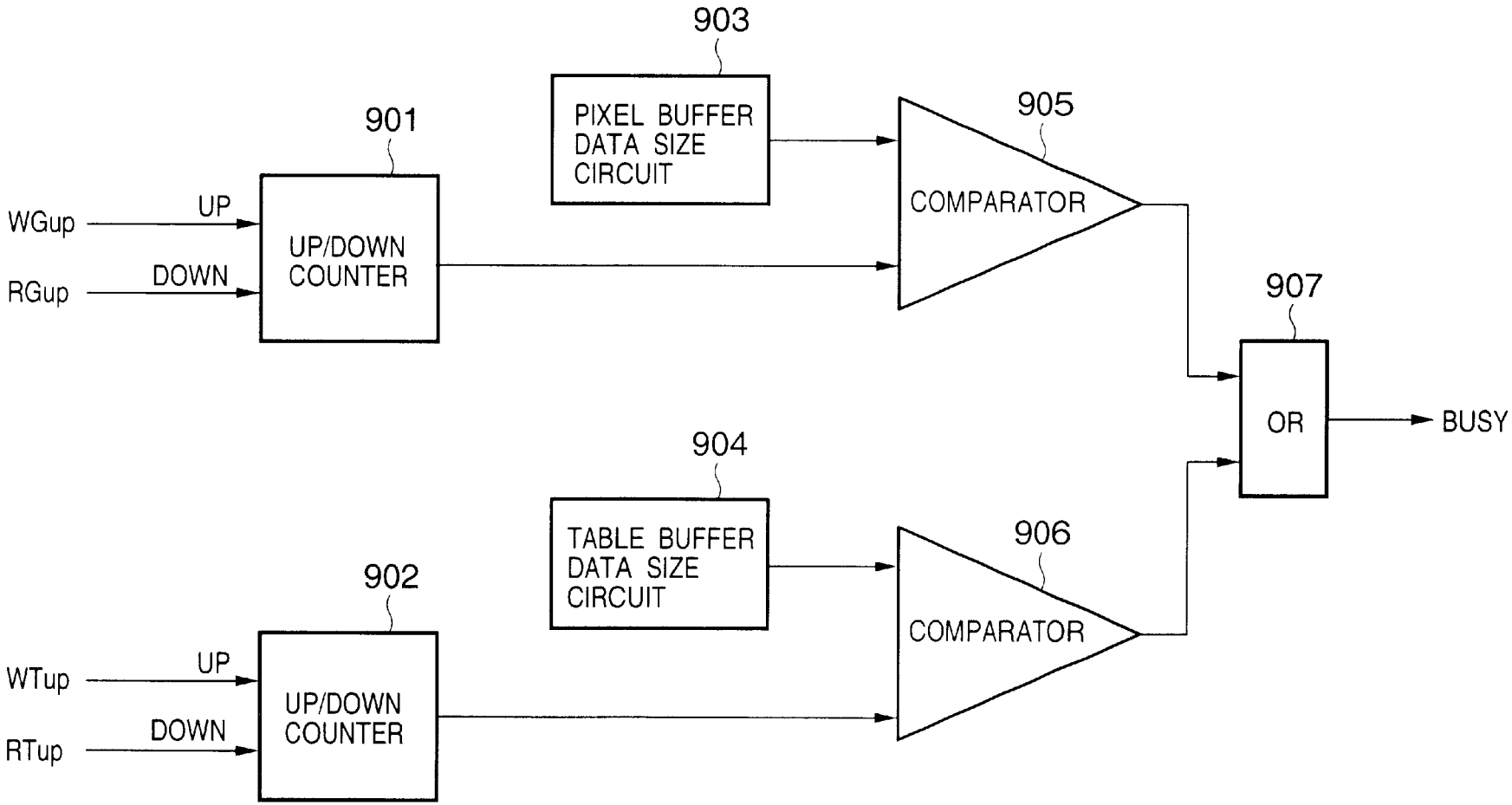
FIG. 9 is a block diagram showing the construction of a BUSY controller in FIG. 1.

FIG. 9 is a block diagram showing the construction of the BUSY controller 109. The BUSY controller 109 has two up/down counters 901 and 902, a pixel buffer data size circuit 903 which outputs a data size for pixel buffer, a table buffer data size circuit 904 which outputs a data size for table buffer, two comparators 905 and 906, and an OR circuit 907.

The signal lines WGup and RGup from the writing controller 103 and the reading controller 112 are connected to the UP and the DOWN of the up/down counter 901. By the connection, as the number of read data is subtracted from the number of data written in the memory, the number of data remaining in the memory is inputted into the up/down counter 901. The comparator 903 compares the output value from the up/down counter 901 with the output from the pixel buffer size circuit 903. If the number of data in the memory corresponds to the pixel buffer size, a signal is asserted by the comparator 905, then it is outputted through the OR circuit 907 as the signal BUSY. A similar operation is performed on the signals WTup and RTup to manage the remaining buffer amount.

Figure 14:
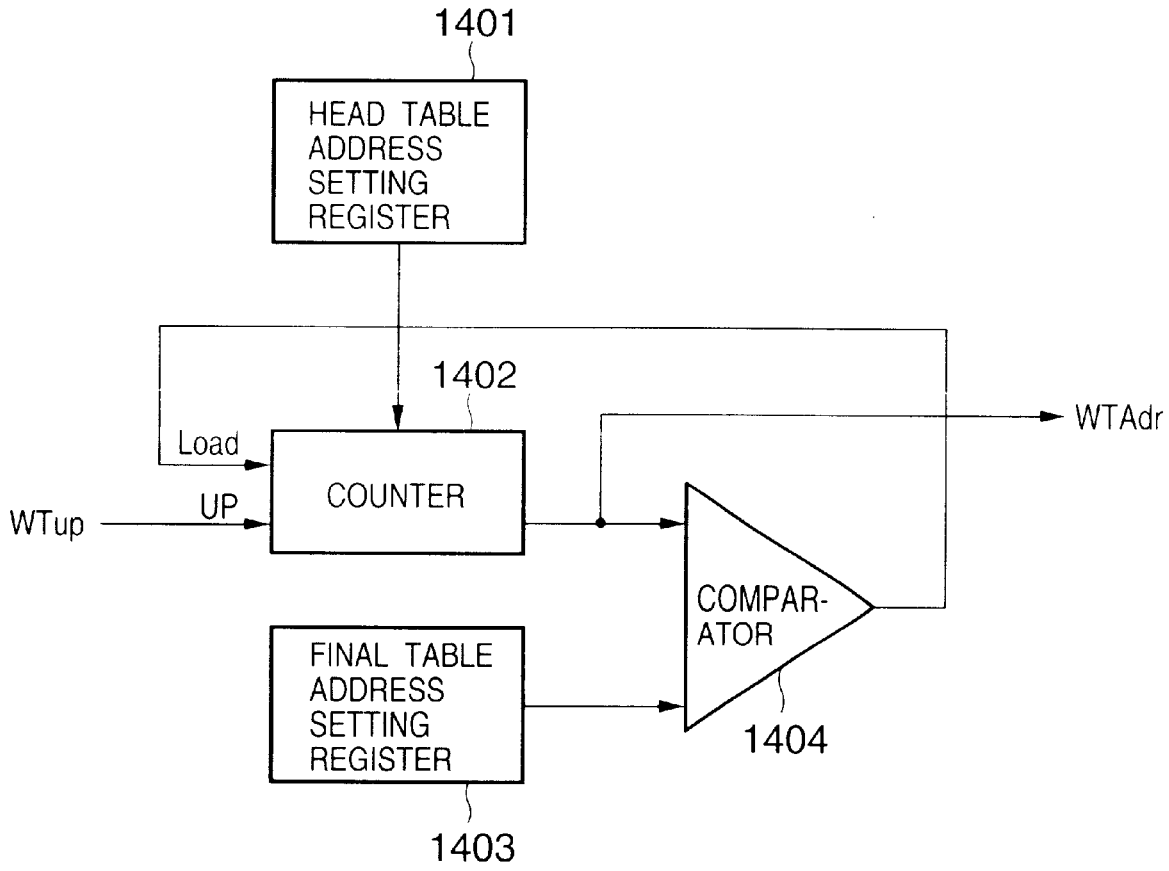
FIG. 14 is a block diagram showing the construction of W table writing address controller in FIG. 1.

FIG. 14 is a block diagram showing the construction of the W table writing address controller 104. The W table writing address controller 104 has a head table address setting register 1401, a counter 1402, a final table address setting register 1403, and a comparator 1404.

The counter 1402 is incremented by input of the signal WTup. When the value of the counter 1402 becomes equal to that of the final table address setting register 1403, the comparator 1404 generates a signal to load the information in the head table address setting register 1401 to the counter 1402, and the counter 1402 is initialized.

Figure 15:
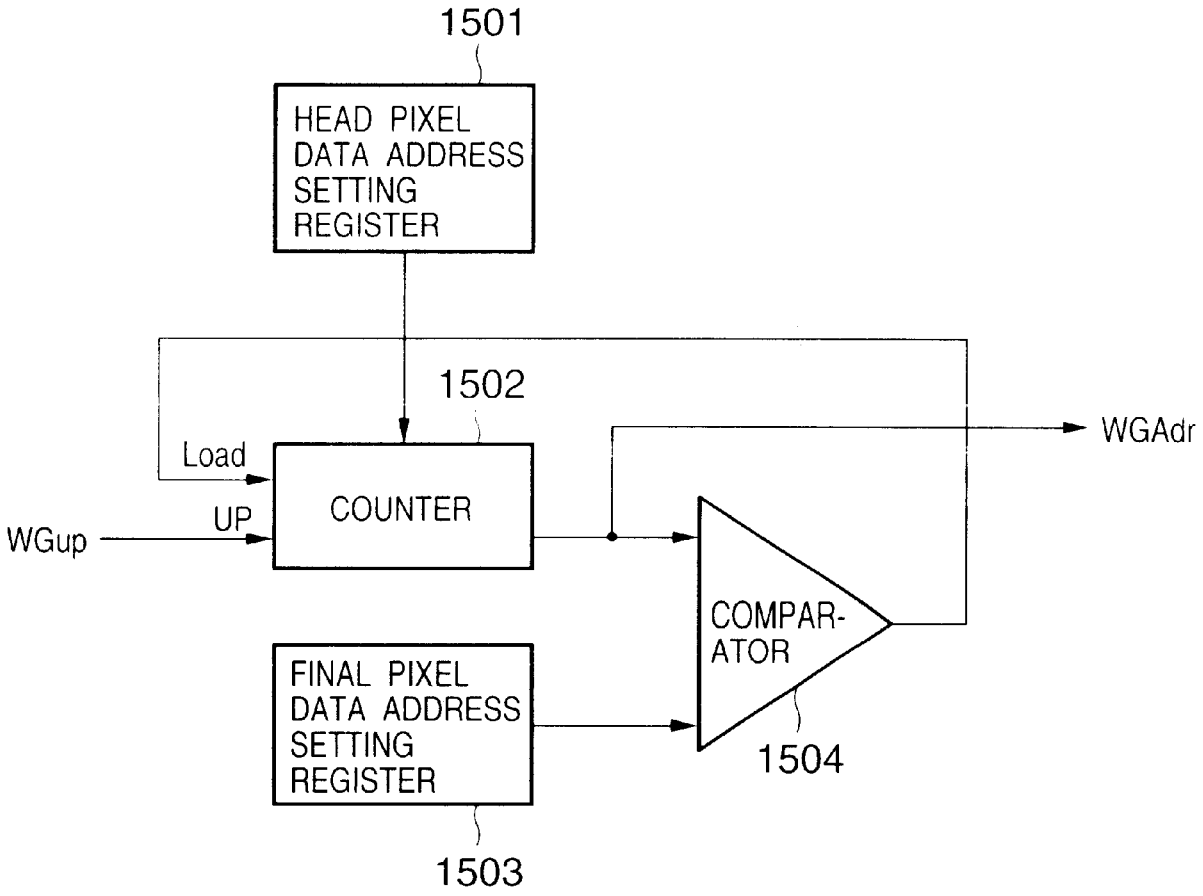
FIG. 15 is a block diagram showing the construction of W pixel block writing address controller in FIG. 1.

FIG. 15 is a block diagram showing the construction of the W pixel block writing address controller 105. The W pixel block writing address controller 105 has a head pixel data address setting register 1501, a counter 1502, a final pixel data address setting register 1503, and a comparator 1504.

The counter 1502 is incremented by input of the signal WGup. When the value of the counter 1502 becomes equal to that of the final pixel data address setting register 1503, the comparator 1504 generates a signal to load the information in the head pixel data address setting register 1501 to the counter 1502, and the counter 1502 is initialized.

Figure 16:
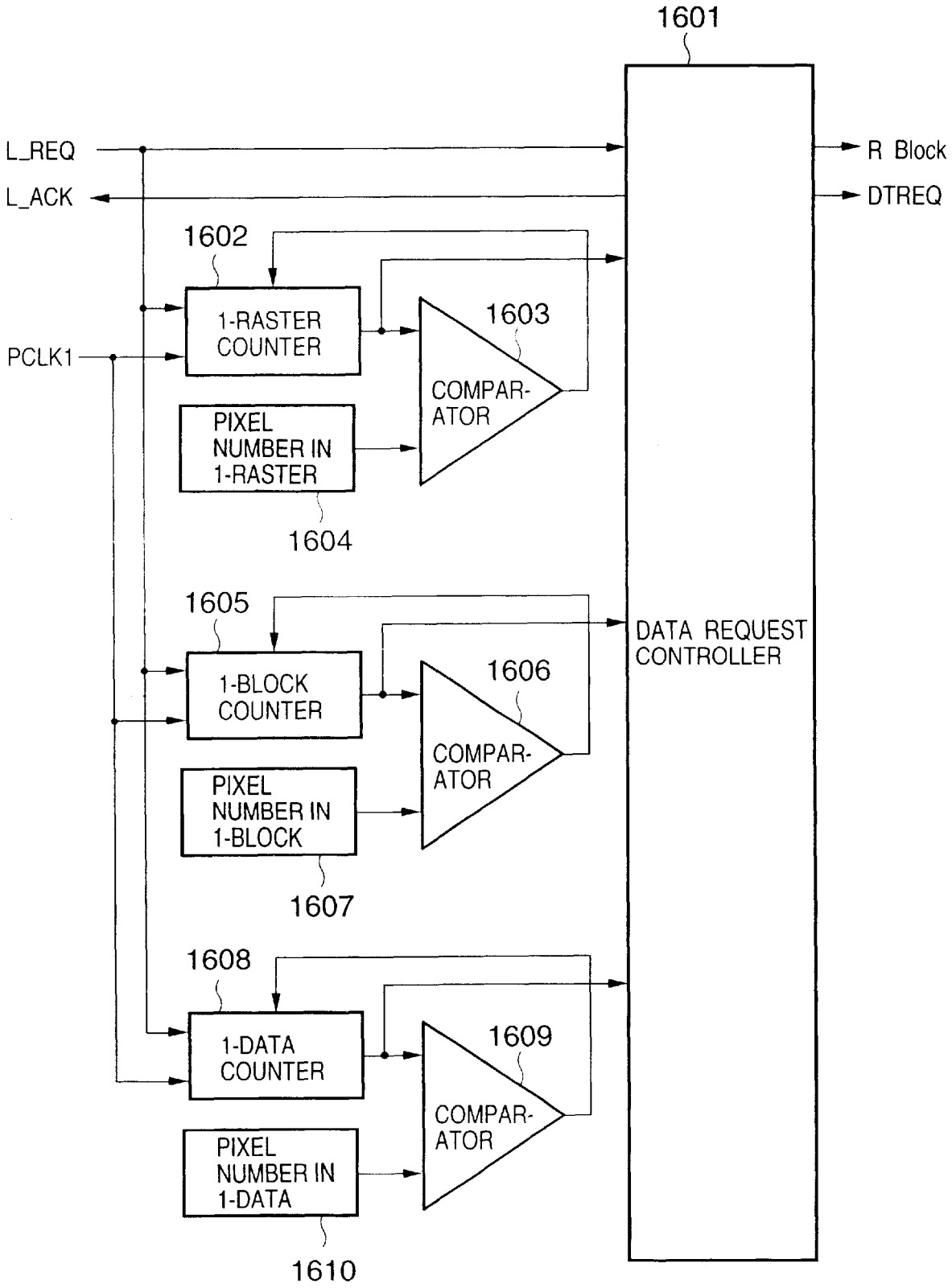
FIG. 16 is a block diagram showing the construction of an R block controller in FIG. 1.

FIG. 16 is a block diagram showing the construction of the R block controller 110. The R block controller 110, for data management in units of raster, pixel block and data, have counters, number-of-pixel registers, and comparators for the respective units.

When the image data reading request signal L_REQ signal is asserted, values of respective counters 1602, 1605 and 1608 are cleared. In this status, a data request controller 1601 checks the initial state of the 1-block counter 1605 and that of the 1-data counter 1608, and asserts the signals RBlock and DTREQ. Then the respective counters are incremented by input of the signal PCLK1.

Figure 17:
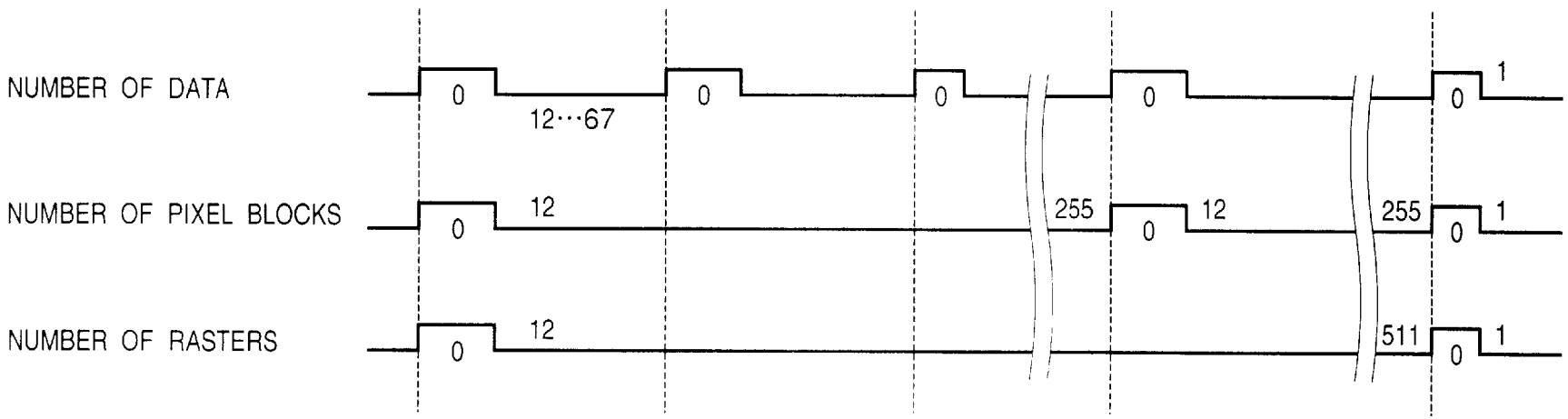
FIG. 17 is a timing chart showing an example of counter output values in FIG. 16.

FIG. 17 is a timing chart showing the change of count values of the respective counters. The 1-data counter 1608 is cleared each time the counter value becomes equal to the value of the pixel per 1-data register 1610 (the register value=8), and up-counting in the 1 block counter 1605 is started again. The 1-block counter 1605 is cleared each time the counter value becomes equal to the value of the pixel per 1-block register 1607 (the register value=256). Further, 1-raster counter 1602 is cleared each time the counter value becomes equal to the number of clocks for 1 raster (the register value=512), and the data request controller 1601 judges the state and asserts the signal L_ACK.

Figure 10:
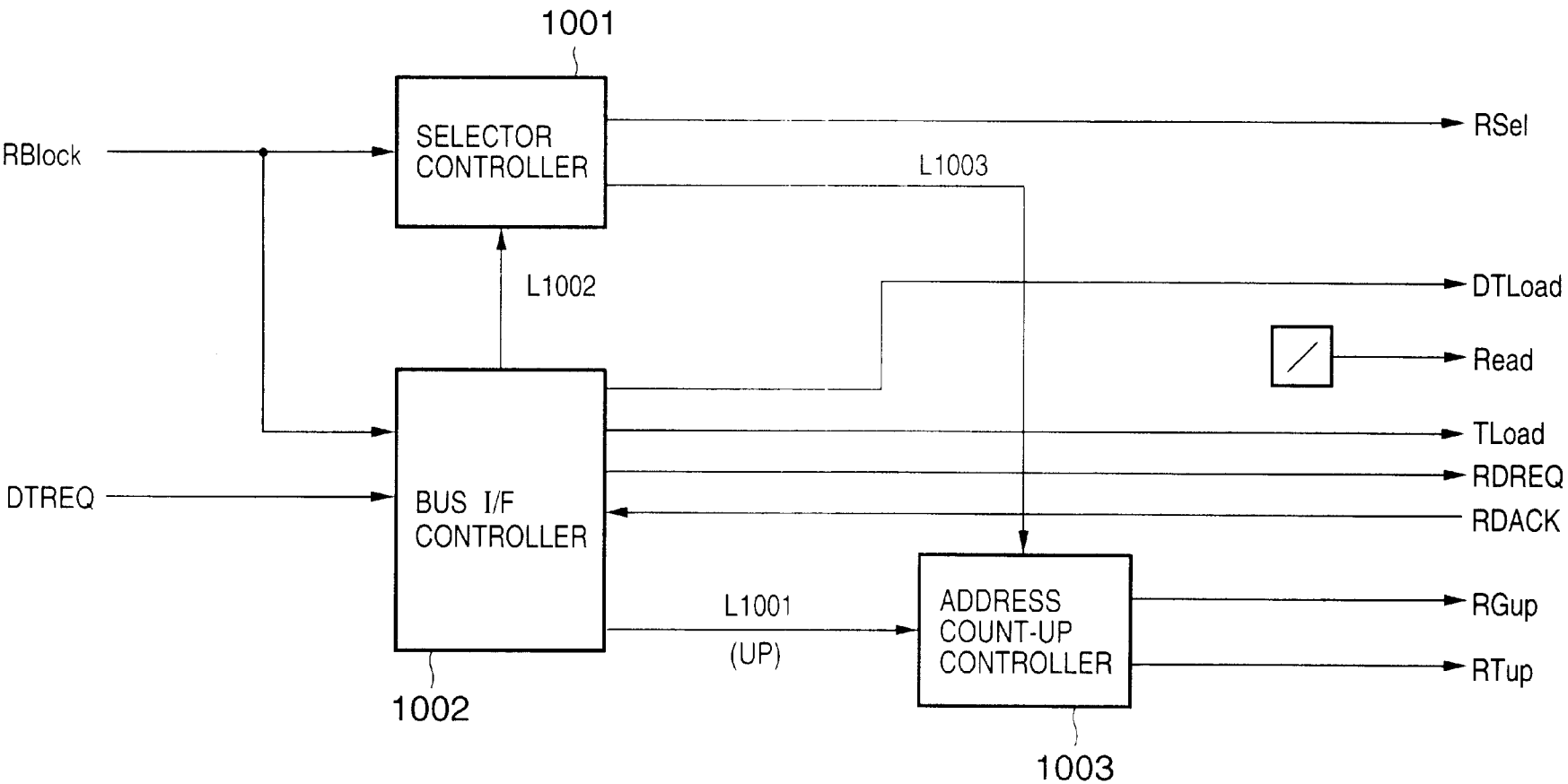
FIG. 10 is a block diagram showing the construction of a reading controller in FIG. 1.

FIG. 10 is a block diagram showing the construction of the reading controller 112. The reading controller 112 has a selector controller 1001, a bus I/F controller 1002, and an address count-up controller 1003.

The asserted state of the signals RBlock and DTREQ as a factor of data reading from the RAM is controlled by the bus I/F controller 1002. Access to table area is required by the signal RBlock, and access to image data area is required by the signal DTREQ. When the two signals are simultaneously asserted, processing is first performed on the RBlock signal having priority.

When the signal RBlock is asserted, the selector controller 1001 asserts the signal RSel, and asserts a signal L1003 to the address count-up controller 1003. When an UP signal L1001 from the bus I/F controller 1002 is asserted while the signal L1003 is in the asserted state, the address count-up controller 1003 asserts the signal RTup. Upon the assertion of the signal RBlock by the bus I/F controller 1002, the bus I/F controller 1002 asserts the signal RDREQ. When the RDACK signal is asserted in response to the asserted signal, the bus I/F controller 1002 outputs the signal RDACK, and at the same time, negates the signal RDREQ.

Further, the signal TLoad and the UP signal L1001 are asserted. By the assertion of the UP signal L1001, the address count-up controller 1003 asserts the signal RTup. Then, the bus I/F controller 1002 asserts a signal L1002 to the selector controller 1001, and the selector controller 1001 negates the signals L1003 and RSel to the address count-up controller.

The operation by the signal RBlock is as described above. Next, the sequence by the assertion of the DTREQ will be described. By the assertion of the signal DTREQ, the bus I/F controller 1002 asserts the signal RDREQ. This signal is negated by the assertion of the signal RDACK, and at the same time, the signal DTLoad and the UP signal L1001 are asserted. In this status, as the signal L1003 from the selector controller 1001 to the address count-up controller 1003 is in the negated state, the address count-up controller 1003 asserts the signal RGup.

Figure 12:
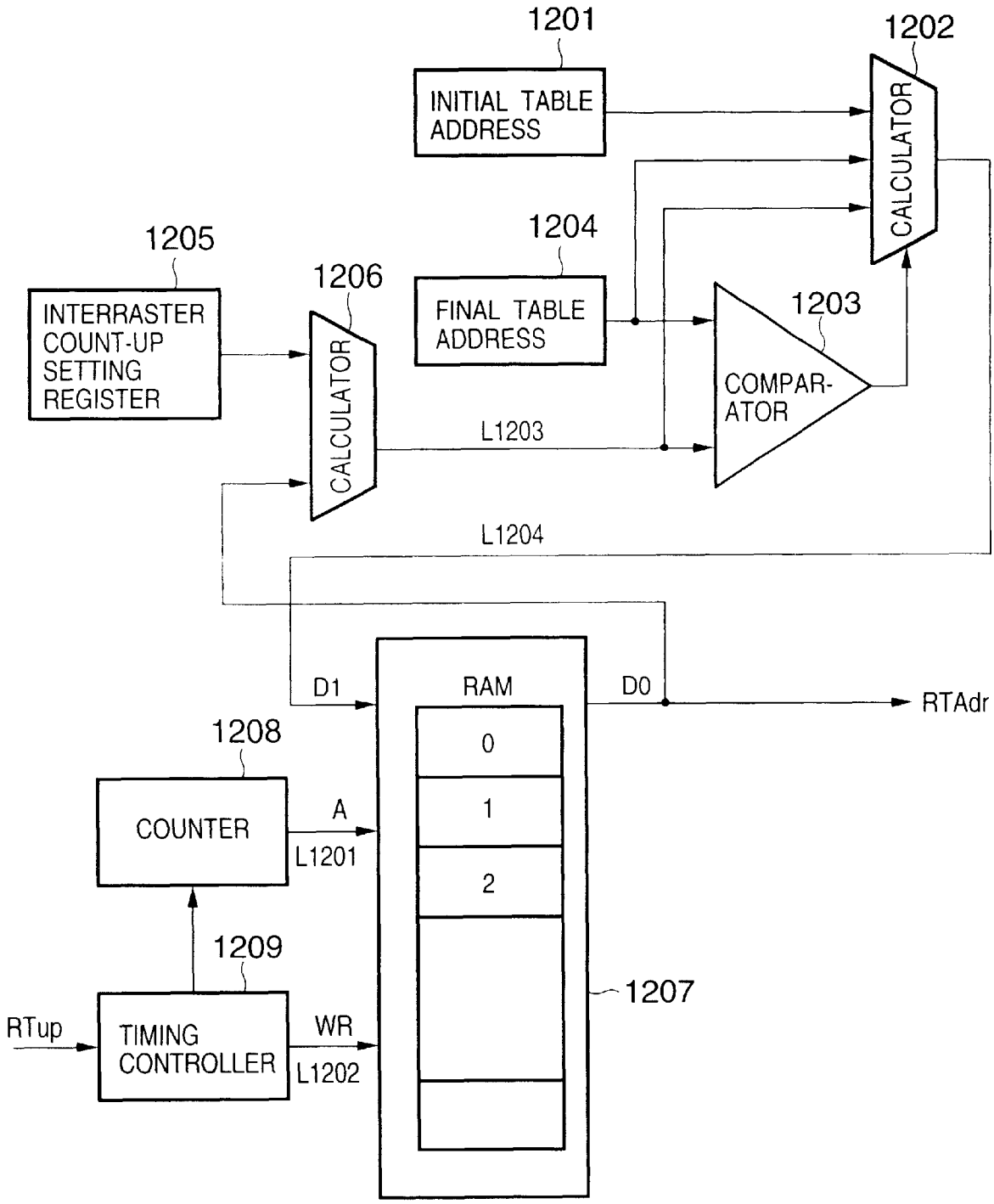
FIG. 12 is a block diagram showing the construction of a table reading address controller in FIG. 1.

Next, the R table reading address controller 113 will be described with reference to the block diagram of FIG. 12. As shown in FIG. 12, the R table reading address controller 113 has a RAM 1207. In an initial status, a counter 1208 is cleared.

When the counter 1208 is in the initial state, a clear value is outputted on an address line L1201 inputted into the RAM 1207. At this time, an initial address of the RAM 1207, i.e., an address "0", is inputted. In this status, data of the address "0" is outputted from the RAM 1207 from an output line DO. In this embodiment, an address of the table holding head address information of the first pixel block is stored in the address "0". Similarly, in an address "1", address information of the table holding head address information of the second pixel block is stored; in an address "2", address information of the table holding head address of the third pixel block is stored; and in an address "3", address information of the table holding head address of the fourth pixel block is stored.

Accordingly, as the information outputted from the RAM 1207 in the initial state, address information of the table holding head address information of the first pixel block is outputted. When the signal RTup is asserted, the timing controller 1209 asserts a data writing signal L1202 to the RAM 1207. When the signal L1202 is asserted, information of the signal L1201 connected to a data input terminal DI of the RAM is written into the current address.

The signal line L1201 in a normal state is controlled as follows. The value of an interraster count-up setting register 1205 is added to an output signal from the RAM 1207. The number of pixel blocks within one raster is the interraster count-up value used for calculation of the next table position. An adder 1206 adds the value of the interraster count-up setting register 1205 to the content of the current table address, and a comparator 1203 compares a signal L1203 indicating the result of addition with the final table address 1204.

The calculation method of a calculator 1202 differs depending on the state of the comparator 1203. If the comparator 1203 determines that the value of the signal L1203 is less than the final table address, the calculator 1202 does not perform any calculation. On the other hand, if the value of the signal L1203 is equal to or greater than the final table address 1204, the calculator 1202 subtracts the final table address from the value of the signal L1203, then adds the value of the initial table address 1201 to the value, and outputs the resulted value to a signal L1204.

Accordingly, in the initial status, the signal L1204 has information obtained by addition between the value of the interraster count-up setting register 1205 and the information of the signal RTAdr, and is written into a designated RAM address by the assertion of the writing signal L1202 by the timing controller 1209. Then, the timing controller 1209 sends a count-up instruction to the counter 1208, to start incremental counting, to designate the next address in the RAM 1207. When the signal RTup corresponding to the number of pixel blocks within one raster is asserted, the timing controller 1209 clears the counter 1208 to the initial state.

Figure 18:
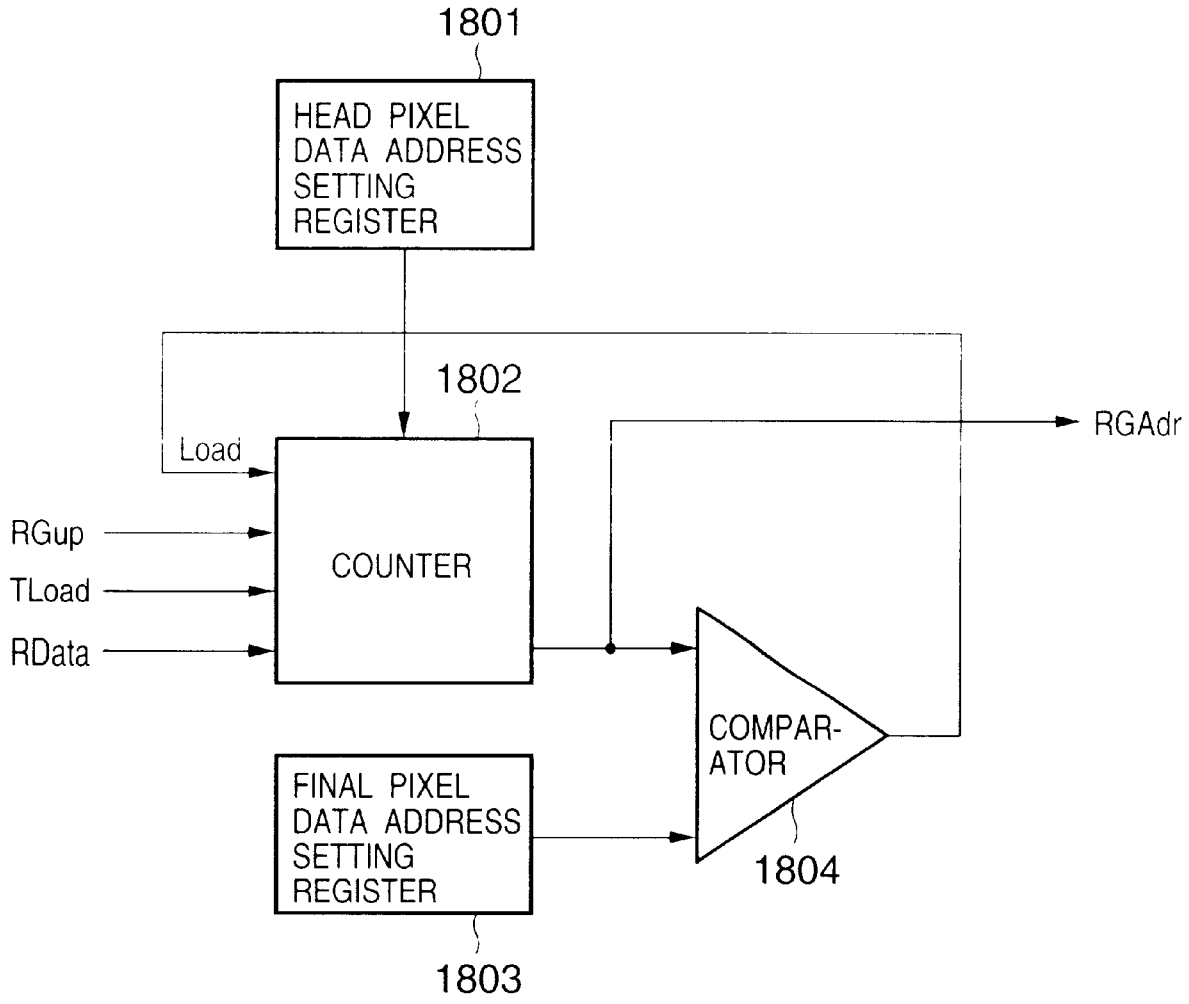
FIG. 18 is a block diagram showing an R block reading address controller in FIG. 1.

FIG. 18 is a block diagram showing the construction of the R pixel block reading address controller 114. The R pixel block reading address controller 114 has a head pixel data address setting register 1801, a counter 1802, a final pixel data address setting register 1803, and a comparator 1804.

The counter 1802 is set with the signal RData as the counter value by the assertion of the signal TLoad. Further, upon assertion of output from the comparator 1804, the counter is set to the content of the head pixel data address setting register 1801 as an initial value. The comparator 1804 compares the output from the counter 1802 with the content of the final pixel data address setting register 1803, and if the output information from the counter 1802 is greater than the final pixel data address setting register 1803, asserts the output. That is, when the signal RGup is asserted, in the counter 1802, incremental counting is repeatedly performed between the values in accordance with the pixel head data address setting register 1801 and the final pixel data address setting register 1803, and when the signal TLoad is asserted, the counter is set to the information of the signal RData at that time.

Figure 11:
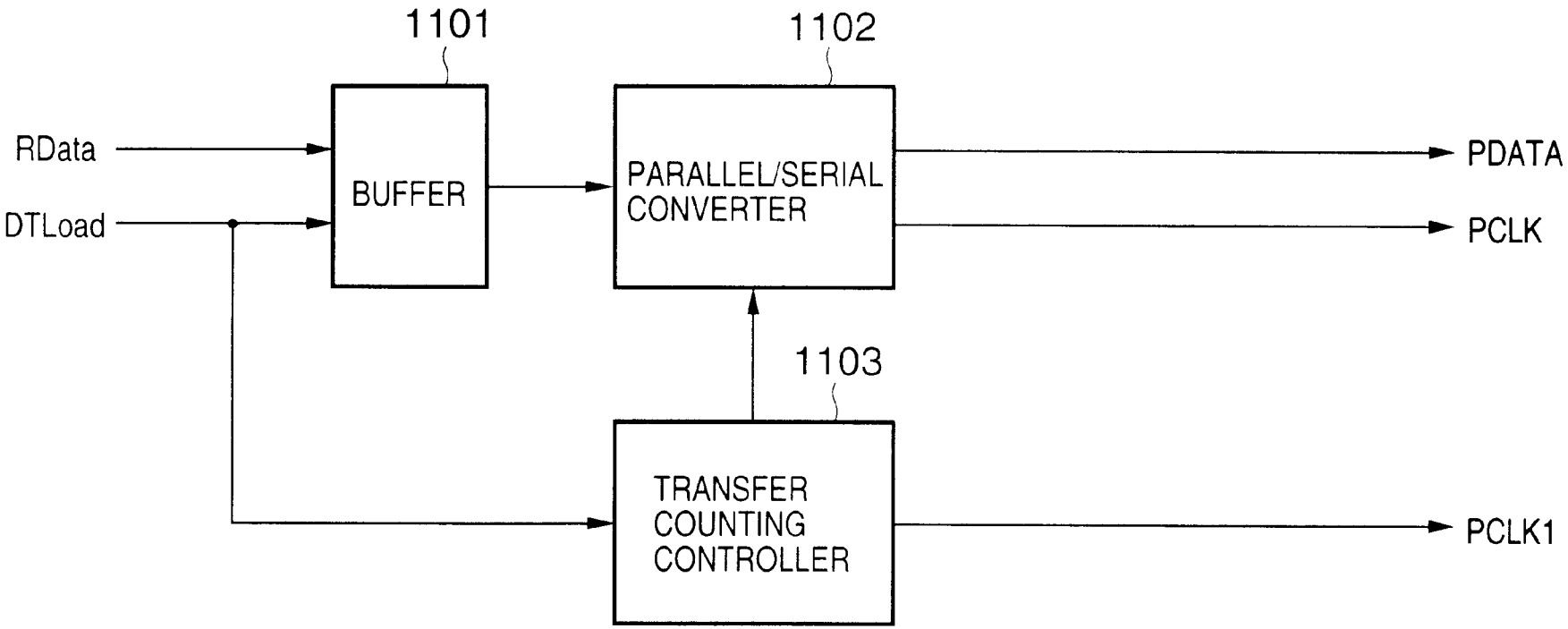
FIG. 11 is a block diagram showing the construction of an image output unit in FIG. 1.

FIG. 11 is a block diagram showing the construction of the image output unit 111. The image output unit 111 has a buffer 1101, a parallel/serial converter 1102, and a transfer counting controller 1103.

When the signal DTLoad is asserted, the state of the signal RData is inputted into the buffer 1101. At the same time, the transfer counting controller 1103 starts the parallel/serial converter 1102, to convert the data in the buffer into serial state data, then output the signal PDATA in synchronization with the signal PCLK. Further, the transfer counting controller 1103 outputs the signal PCLK1 in synchronization with the signal PCLK.

Figures 2A, 2B:
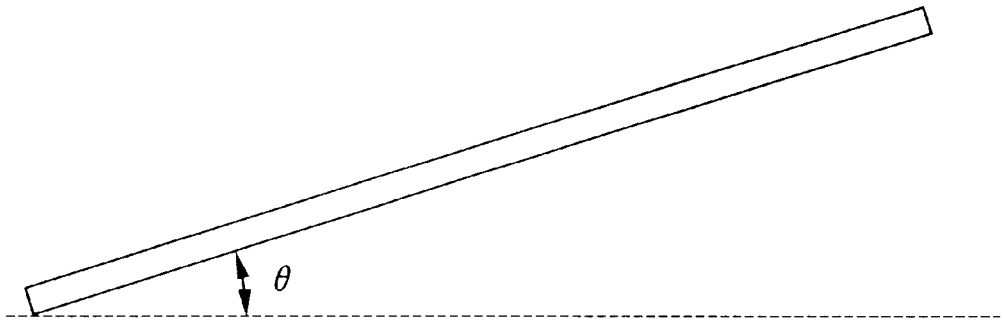
FIGS. 2A and 2B are a table and an explanatory view showing the relation between an attachment angle of printhead and image data.

FIGS. 2A and 2B show the relation between arrangement direction of the printhead and image data. FIG. 2A shows pixel block reading positions in the present embodiment in a case where the relative tilt of the printhead is as shown in FIG. 2B. As shown in FIG. 2A, four pixel blocks are arranged in a horizontal direction and eight rasters are arranged in a vertical direction.

If the printhead has a tilt angle θ as shown in FIG. 2B, image data must be read in an order corresponding to the tilt angle θ and sent to the printhead. In FIG. 2B, hatched portions are image data corresponding to the relative tilt angle of the printhead. The image data must be sent to the printhead in a status where these hatched portions are connected with each other. If image data transferred to the image processing unit is raster data, the writing/reading order must be appropriately changed upon pixel block writing/reading processing.

In the present embodiment, upon reading, the reading order is controlled as described in FIG. 1. Further, upon writing, writing control may be performed to change the writing order. Further, upon writing and reading, writing control and reading control may be performed to change the writing order and the reading order.

Figure 3:
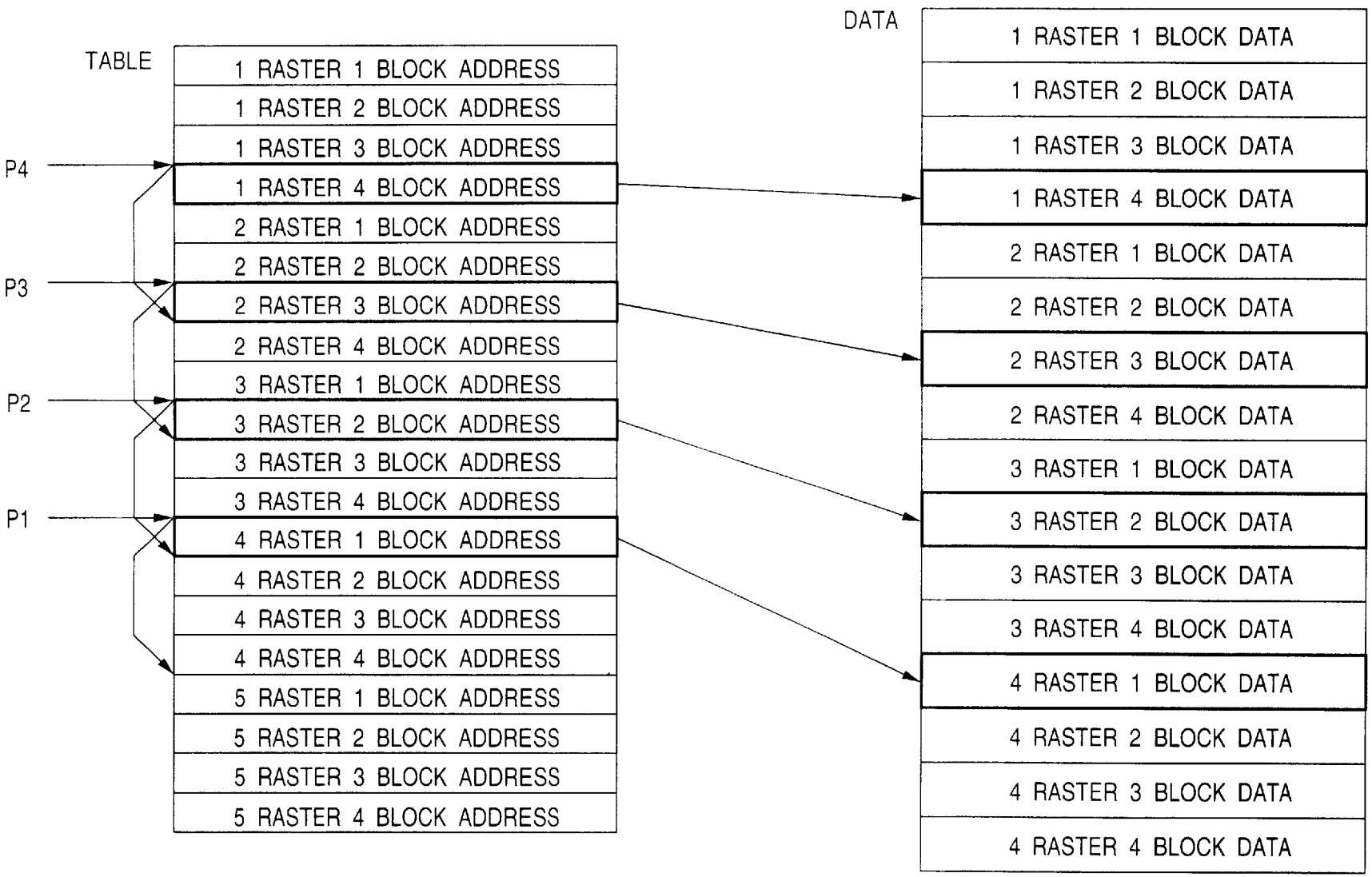
FIG. 3 illustrates a memory map for storing image data.

FIG. 3 shows a memory map upon writing in which image data is divided into pixel blocks and sequentially stored into the memory. Accordingly, the image data in the memory is arrayed in accordance with the number of rasters in ascending order from the top to the bottom, and in accordance with the number of pixel blocks in ascending order from the left to the right. The image data with smaller numbers are data received at earlier times.

In this manner, to manage the received image data in pixel block units, a table holding addresses of head image data of pixel block is provided. The table is used for obtaining the head position of each pixel block in a short period, and any means with any construction may be employed as long as a necessary pixel address can be easily found within a short period.

FIG. 3 shows an example of search using such table. The image data is stored in pixel block unit, in input order into the image processing unit. Further, the head addresses of pixel blocks are sequentially stored into the table. As represented in the order of the hatched portions in FIG. 2A, i.e., (the number of rasters-the number of blocks), the image data is transmitted in the order (4-1), (3-2), (2-3), and (1-4). From the first pixel block, 4-raster data is transferred; from the second pixel block, 3-raster data is transferred; from the third pixel block, 2-raster data is transferred; and from the fourth pixel block, 1-raster data is transferred.

As shown in the table of FIG. 3, one pointer Pn is provided for each pixel block (Pn (n=1, 2, 3, 4)). P1 indicates the 4 raster pixel block; p2, the 3 raster pixel block; P3, the 2 raster pixel block; and P4, the 1 raster pixel block. As the table information designated by the pointer Pn, a head address of the memory holding image data of the corresponding pixel block is stored. By using the above table information, image data of a corresponding pixel block can be read in a short period. Note that in FIG. 3, it seems that the table and the data are stored in separate memories; however, one memory may hold this information, or separate memories may hold this information.

Figure 13:
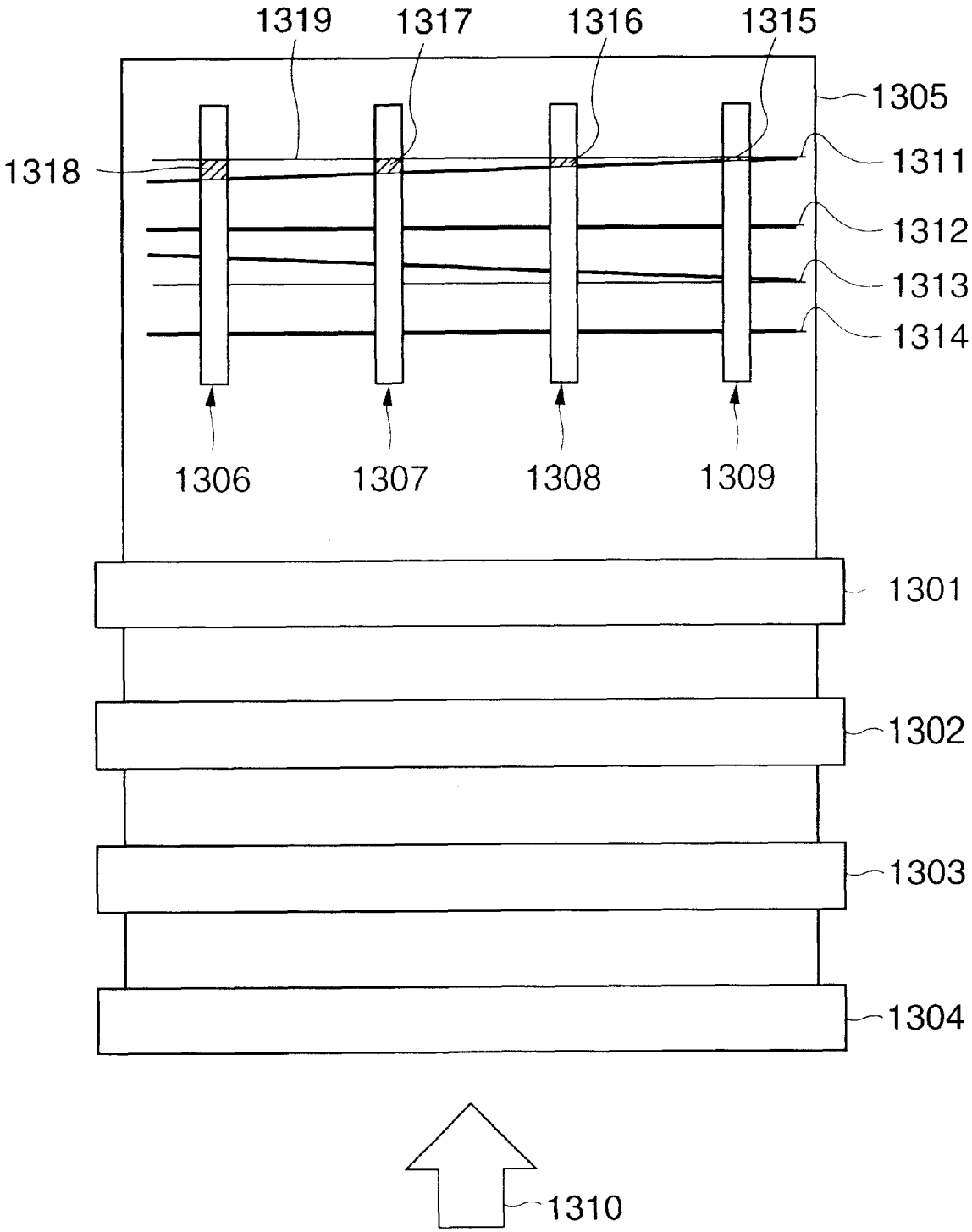
FIG. 13 is a schematic diagram showing the construction to detect a relative angle of the printhead.

Next, a method for detecting the tilt angle of the printhead will be described with reference to FIG. 13. In FIG. 13, numerals 1301 to 1304 denote printheads which perform printing on a printing surface of a print medium 1305. Numerals 1306 to 1309 denote CCD sensors which detect relative angles of the respective printheads from images formed by the respective printheads.

To detect the relative angle of the printhead, it is desirable to print a pattern representing a structural feature such as attachment status by the printhead. In the present embodiment where an image is printed in raster units, it is appropriate to perform the above determination with an image drawn by one raster drawing.

In FIG. 13, thick-line segments 1311 to 1314 are results from printing by the printheads 1301 to 1304. The printing results are moved by a transfer device (not shown) to measurement-possible positions for the CCD's 1306 to 1309. The CCD's 1306 to 1309 are line sensors each having sensors arrayed in a vertical direction in FIG. 13. Positional shifts among the respective CCD's are corrected in advance.

For example, assuming that the line segment 1312 is in a reference position as a result of measurement of printing results by the CCD sensors, the left end of the line segment 1311 is tilted to the line segment 1312. The tilt amount of the line segment 1311 is measured in the respective positions of the CCD sensors, and differences 1316 to 1318 are obtained as measurement results. The relative position of the printhead is determined from the difference amounts and the resolutions of the CCD sensors, and 1-raster data structure to be transmitted to the printhead upon printing is determined based on the difference amounts. That is, the pixel block position and the raster position to be printed by the printhead 1301 are determined.

FIG. 4 is a timing chart showing operations in the RAM. The RAM generally has an address bus, a data bus, and a control bus. Since the control method for a RAM greatly differs depending on the type of RAM and a common explanation cannot be made, FIG. 4 shows only representative signals. The signals handled in FIG. 4 are for RAM address, data, and Read/Write signal lines, indicating the events are time-sequentially arrayed from left to right in FIG. 4.

In FIG. 4, events 1 to 3 correspond to an image data writing sequence, and events 9 to 6, to a reading sequence. In the event 1, address information of pixel [m,n] is written into a table address [m,n]. Note that [m,n,o] is m-raster and n-pixel block address or data, and "o" is a data order within the pixel block. Data existing within one pixel block can be read from the RAM by one or more data access. In the event 2, from the address of the pixel [m,n] read in the event 1, the first image data in the [m,n] pixel block is read from the RAM. In the event 3, image data in the [m,n] pixel block continued from the event 2 is read.

On the other hand, in the data reading sequence, in the event 4, k-th data as the final image data in a [i,j] pixel block is read. In the event 5, head address information in the next pixel block [i,j+1] is read from the table. In the event 6, head image data in the pixel block [i,j+1] read in the event 5 is read. Thus, the table and data access in this manner enables image data reading/writing from/to the RAM.

Figure 22:
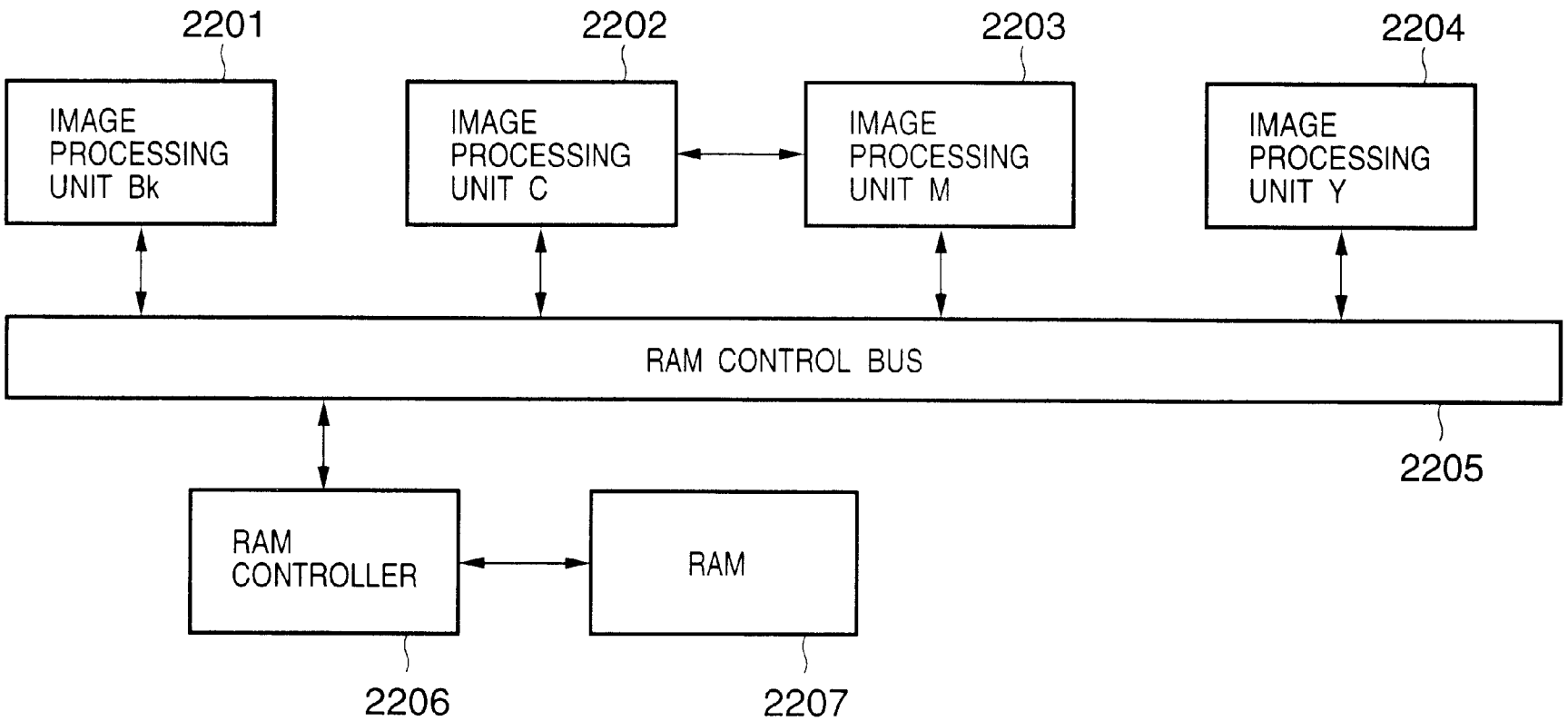
FIG. 22 is a block diagram showing the control construction of the printing apparatus having plural printheads.

The printing apparatus as described above has one image processing unit; however, to perform color image printing, it has plural printheads corresponding to the number of plural inks, and has plural image processing units. FIG. 22 shows the construction of the printing apparatus having four image processing units for black, cyan, magenta and yellow colors. In FIG. 22, letters Bk represent black; C, cyan; M, magenta; and Y, yellow.

The above four color image processing units 2201 to 2204 are connected to the RAM control bus, and one RAM controller 2206 is directly connected to a RAM 2207. In this printing apparatus, the memory can be more efficiently used in comparison with the printing apparatus shown in FIG. 21.

As an example, a color printing apparatus having four image processing units will be described. In this apparatus, a necessary memory capacity for one image processing unit is 1.25 Mbyte, and an available capacity of the RAM is 1 Mbyte. On this condition, in case of the construction in FIG. 21, four printing apparatuses for the image processing units, i.e., four apparatuses, are required. Then, the memory capacity necessary for the printing apparatus in FIG. 21 is obtained. In the printing apparatus in FIG. 21, to ensure the memory capacity of 1.25 Mbyte, two RAM's are required. Accordingly, if four printing apparatuses in FIG. 21 are used, eight RAM's are required.

However, in the construction where one RAM controller and one RAM are provided for four image processing units as shown in FIG. 22, as the RAM can be shared among the respective units, the printing apparatus can be constructed with a memory capacity 4 times larger than 1.25 Mbyte, i.e., only 5 RAM's. Note that the printing apparatus in FIG. 22 needs a processing capability 4 times faster than the RAM access speed in FIG. 21. However, the number of RAM's in FIG. 22 is smaller than that in FIG. 21. This tendency becomes more pronounced as the amount of image data is reduced by data compression.

FIG. 5 is a timing chart showing an access example in use of a synchronous DRAM which is often used in recent years. In the synchronous DRAM, reading of address information and data information is not completed within one event. Generally, data information is obtained several events after the supply of address information. Accordingly, as shown in FIG. 4, if table information is used as address information of the next event, the high-speed access in the synchronous DRAM cannot be utilized.

For this reason, it is useful to continuously obtain address information of respective pixel blocks constructing one raster to be transferred to the printhead, then sequentially obtain image data of the respective pixel blocks. In FIG. 4, table addresses of the respective pixel blocks used between the event 1 and the event 4 are obtained. For the event 1, a table address to obtain the head address of [i,1] pixel block is provided as the RAM address. Then, address information is provided as the RAM address in the order [i-1,2], [i-2,3] and [i-3,4].

Further, the data information is supplied from the event 3 delayed by two events from the supply of the address information. In the event 3, information in a [i,1,1] pixel block, [i-1,2,1], [i-2,3,1] and [i-3,4,1] are sequentially provided. At this time, from the relation between the number of pixel block, within one raster and the latency of the synchronous DRAM, if the number of pixel blocks is greater than the latency of the synchronous DRAM, in the event next to acquisition of table address of pixel block, address information for reading image data in a pixel block where the head address has been obtained can be provided as the RAM address.

By this method, in a higher-speed access RAM such as a synchronous DRAM, its high speed access characteristic can be fully utilized, and high-speed data acquisition is possible.

Figure 19:
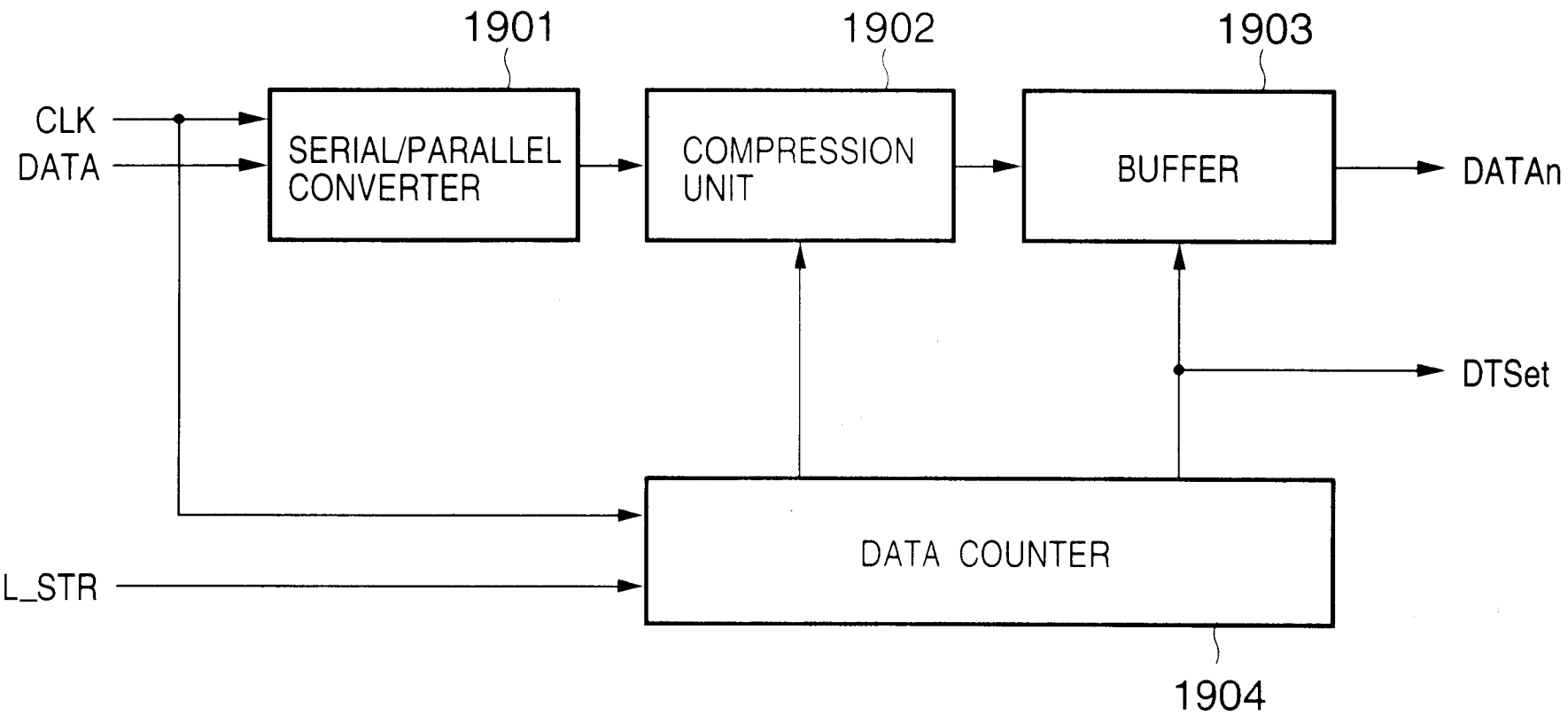
FIG. 19 is a block diagram showing the construction in a case where the image input unit has a compression unit.
Figure 20:
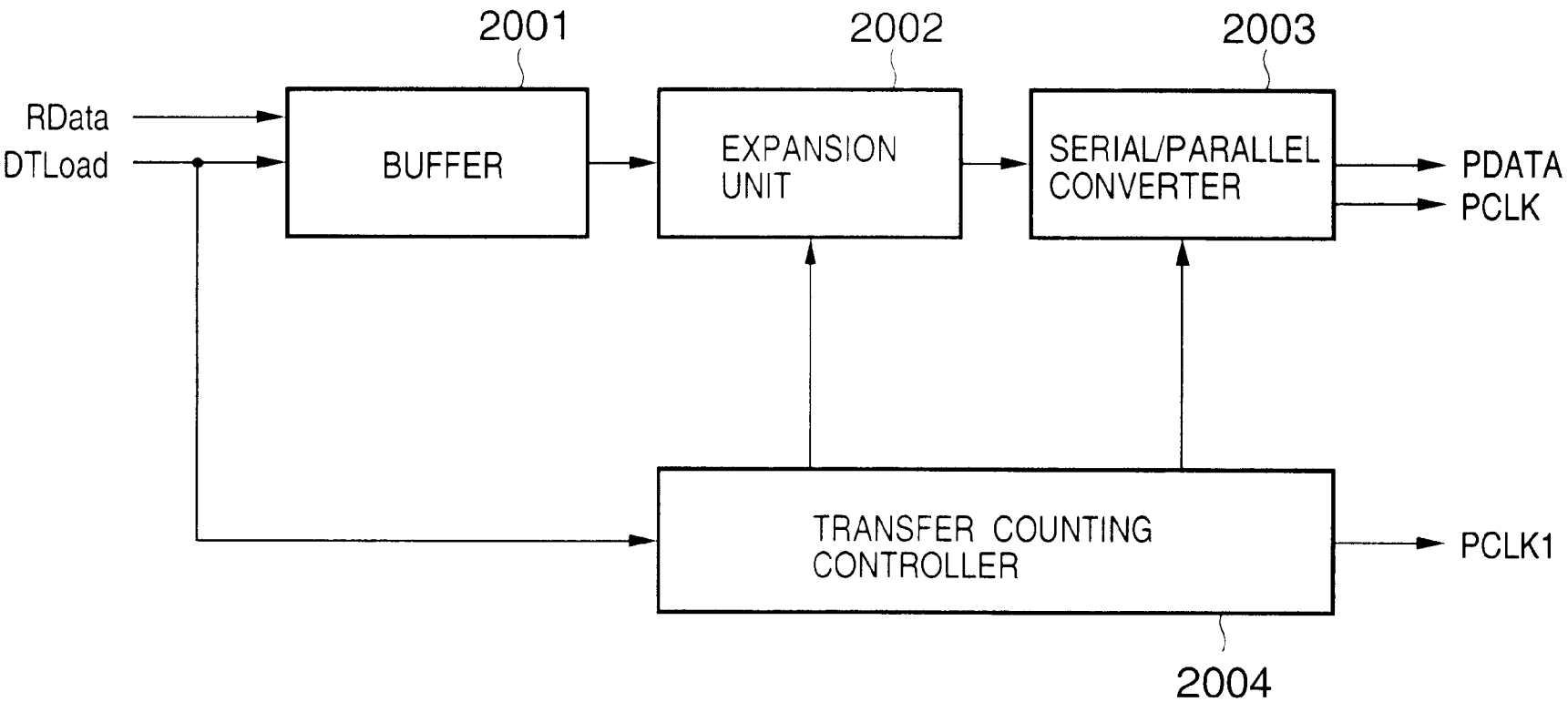
FIG. 20 is a block diagram showing the construction in a case where the image output unit has an expansion unit.

Further, a compression/expansion function may be added to the embodiment as described above. FIGS. 19 and 20 show an example in use of data compression unit 1902 and data expansion unit 2002 in the image input unit 101 and the image output unit 111.

The image input unit 101 in FIG. 19 has the image data compression unit 1902 added after a serial/parallel conversion unit 1901. Compressed data is inputted into a buffer 1903, and stored in the memory.

As a data compression method, an optimum method for image data is desirable. Further, the compression speed is a significant factor. In case of binary data, compression methods such as J-BIG, packbits, run-length and the like can be used, while in case of multi-valued data, the J-PEG method can be used in some cases. In use of the J-PEG method, the width of one raster is influenced by the block size.

Further, an expansion unit to expand data compressed by the above compression means must be provided for data reproduction in the image output unit in FIG. 20. By this addition of data compression and expansion units, the amount of RAM access can be reduced, and bus timing designing can be facilitated.

Next, the operation of the printing apparatus of the present embodiment will be described with reference to the flowchart of FIG. 23.

First, the relative angle of the printhead is detected (step S1) in the method as described in FIG. 13. The detected relative angle is stored in an appropriate memory position. If plural printheads are used, the relative angles of the respective printheads are obtained. It is not necessary to detect the relative angle upon each printing. As the relative angle is not changed until the printhead is exchanged for another printhead, in use of the same printhead, the stored data on the relative angle is read.

Next, image data for printing, received in raster format, is divided in plural pixel blocks (step S2) by the W block controller in FIG. 7 and the writing controller in FIG. 8 and the like. Further, at this time, data compression may be performed in accordance with necessity. The divided pixel blocks are stored into storage means (memory) (step S3). The memory storage format is as that of the memory map in FIG. 3.

Then, the order of data reading is determined in correspondence with the detected relative angle of the printhead (step S4) as described above in FIG. 2.

When the reading order has been determined, the data are read in block units from the storage means in accordance with the determined order, and are transferred to the printhead (step S5). The printhead performs printing based on the data on a print medium.

It is determined whether or not all the printing has been completed (step S6), and if the printing has not been completed, the next data is set (step S7), then the process returns to step S5, to perform the reading and transfer. When printing based on all the data has been completed, the operation is terminated.

As described above, according to the present embodiment, detection means for detecting a relative angle of printhead is provided so as to detect the tilt of the printhead, and an optimum pixel-block reading order, as registration adjustment means, can be selected in accordance with the detected angle within a short period. Further, the construction is applicable to a system having plural printheads, and is advantageous in RAM cost reduction.

Especially, by using data compression/expansion, the present invention is applicable to (1) a system where RAM access speed is reduced, and enables (2) further reduction of memory amount. Worthy of special note is that the pixel block size is not necessarily a fixed size, which provides very high flexibility to any system.

The embodiment described above has exemplified a printer, which comprises means (e.g., an electrothermal transducer, laser beam generator, and the like) for generating heat energy as energy utilized upon execution of ink discharge, and causes a change in state of an ink by the heat energy, among the ink-jet printers. According to this ink-jet printer and printing method, a high-density, high-precision printing operation can be attained.

As the typical arrangement and principle of the ink-jet printing system, those practiced by use of the basic principle in, for example, U.S. Pat. Nos. 4,723,129 and 4,740,796 are preferable. The above system is applicable to either one of the so-called on-demand type or continuous type systems. Particularly, in the case of the on-demand type, the system is effective because, by applying at least one driving signal, which corresponds to printing information and gives a rapid temperature rise exceeding nucleate boiling, to each of electrothermal transducers arranged in correspondence with a sheet or liquid channels holding a liquid (ink), heat energy is generated by the electrothermal transducer to effect film boiling on the heat acting surface of the printhead, and consequently, a bubble can be formed in the liquid (ink) in one-to-one correspondence with the driving signal. By discharging the liquid (ink) through a discharge opening by growth and shrinkage of the bubble, at least one droplet is formed. If the driving signal is applied as a pulse signal, the growth and shrinkage of the bubble can be attained instantly and adequately to achieve discharge of the liquid (ink) with particularly high response characteristics.

As the pulse driving signal, signals disclosed in U.S. Pat. Nos. 4,463,359 and 4,345,262 are suitable. Note that further excellent printing can be performed by using the conditions described in U.S. Pat. No. 4,313,124 of the invention which relates to the temperature rise rate of the heat acting surface.

As an arrangement of the printhead, in addition to the arrangement as a combination of discharge nozzles, liquid channels, and electrothermal transducers (linear liquid channels or right angle liquid channels) as disclosed in the above specifications, the arrangement using U.S. Pat. Nos. 4,558,333 and 4,959,600, which disclose the arrangement having a heat acting portion arranged in a flexed region is also included in the present invention. In addition, the present invention can be effectively applied to an arrangement based on Japanese Patent Laid-Open No. 59-123670 which discloses the arrangement using a slot common to a plurality of electrothermal transducers as a discharge portion of the electrothermal transducers, or Japanese Patent Laid-Open No. 59-138461 which discloses the arrangement having an opening for absorbing a pressure wave of heat energy in correspondence with a discharge portion.

Furthermore, as a full line type printhead having a length corresponding to the width of a maximum printing medium which can be printed by the printer, either the arrangement which satisfies the full-line length by combining a plurality of printheads as disclosed in the above specification or the arrangement as a single printhead obtained by forming printheads integrally can be used.

In addition, not only an exchangeable chip type printing head, as described in the above embodiment, which can be electrically connected to the apparatus main unit and can receive an ink from the apparatus main unit upon being mounted on the apparatus main unit but also a cartridge type printing head in which an ink tank is integrally arranged on the printing head itself can be applicable to the present invention.

It is preferable to add recovery means for the printhead, preliminary auxiliary means and the like to the above-described construction of the printer of the present invention since the printing operation can be further stabilized. Examples of such means include, for the printhead, capping means, cleaning means, pressurization or suction means, and preliminary heating means using electrothermal transducers, another heating element, or a combination thereof. It is also effective for stable printing to provide a preliminary discharge mode which performs discharge independently of printing.

Furthermore, as a printing mode of the printer, not only a printing mode using only a primary color such as black or the like, but also at least one of a multi-color mode using a plurality of different colors or a full-color mode achieved by color mixing can be implemented in the printer either by using an integrated printhead or by combining a plurality of printheads.

Moreover, in each of the above-mentioned embodiments of the present invention, it is assumed that the ink is a liquid. Alternatively, the present invention may employ an ink which is solid at room temperature or less and softens or liquefies at room temperature, or an ink which liquefies upon application of a use printing signal, since it is a general practice to perform temperature control of the ink itself within a range from 30° C. to 70° C. in the ink-jet system, so that the ink viscosity can fall within a stable discharge range.

In addition, in order to prevent a temperature rise caused by heat energy by positively utilizing it as energy for causing a change in state of the ink from a solid state to a liquid state, or to prevent evaporation of the ink, an ink which is solid in a non-use state and liquefies upon heating may be used. In any case, an ink which liquefies upon application of heat energy according to a printing signal and is discharged in a liquid state, an ink which begins to solidify when it reaches a printing medium, or the like, is applicable to the present invention. In this case, an ink may be situated opposite electrothermal transducers while being held in a liquid or solid state in recess portions of a porous sheet or through-holes, as described in Japanese Patent Laid-Open No. 54-56847 or 60-71260. In the present invention, the above-mentioned film boiling system is most effective for the above-mentioned inks.

In addition, the ink-jet printer of the present invention may be used in the form of a copying machine combined with a reader and the like, or a facsimile apparatus having a transmission/reception function in addition to an image output terminal of an information processing apparatus such as a computer.

The present invention can be applied to a system constituted by a plurality of devices (e.g., a host computer, an interface, a reader and a printer) or to an apparatus comprising a single device (e.g., a copy machine or a facsimile machine).

Further, the object of the present invention can be also achieved by providing a storage medium storing program code for performing the aforesaid processes to a system or an apparatus, reading the program code with a computer (e.g., CPU, MPU) of the system or apparatus from the storage medium, then executing the program.

In this case, the program code read from the storage medium realizes the functions according to the embodiment, and the storage medium storing the program code constitutes the invention.

Further, the storage medium, such as a floppy disk, a hard disk, an optical disk, a magneto-optical disk, CD-ROM, CD-R, a magnetic tape, a non-volatile type memory card, and ROM can be used for providing the program code.

Furthermore, besides aforesaid functions according to the above embodiment being realized by executing the program code which is read by a computer, the present invention includes a case where an OS (operating system) or the like working on the computer performs a part of or entire processes in accordance with designations of the program code and realizes functions according to the above embodiment.

Furthermore, the present invention also includes a case where, after the program code read from the storage medium is written in a function expansion card which is inserted into the computer or in a memory provided in a function expansion unit which is connected to the computer, a CPU or the like contained in the function expansion card or unit performs a part of or entire processes in accordance with designations of the program code and realizes functions of the above embodiment.

Figure 23:
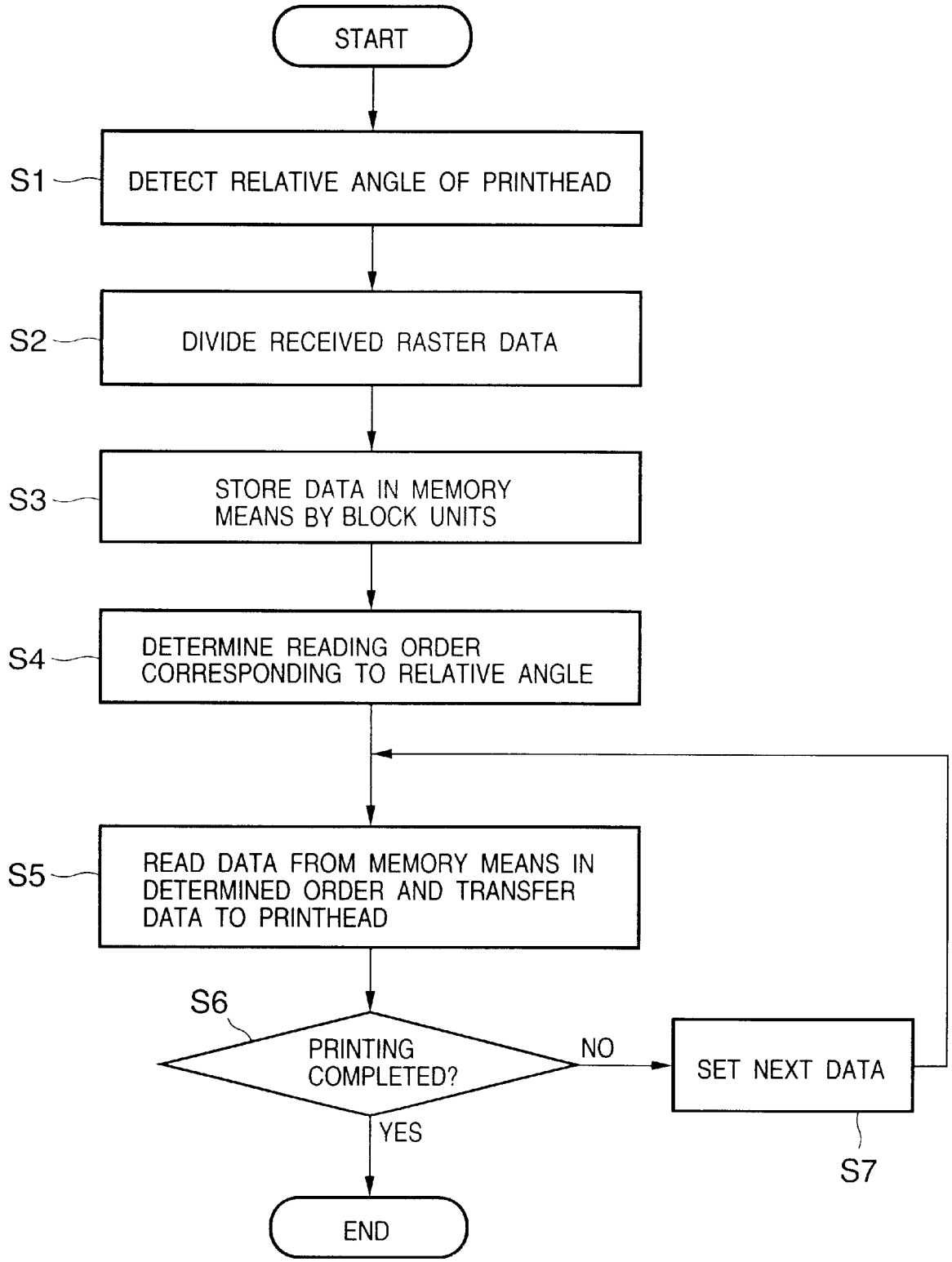
FIG. 23 is a flowchart showing the operation of the printing apparatus according to the embodiment.

When the present invention is applied to the storage medium, the storage medium holds program code corresponding to the aforementioned flowchart (shown in FIG. 23).

As many apparently widely different embodiments of the present invention can be made without departing from the spirit and scope thereof, it is to be understood that the invention is not limited to the specific embodiments thereof except as defined in the appended claims.

What is claimed is:

1. A printing apparatus which performs printing by using a full-line type printhead having a printing area corresponding to a width of a printing area of a print medium, comprising:

detection means for detecting a value regarding a relative angle of said printhead to a transfer direction of said print medium;

division means for dividing image data, received in raster format, into plural pixel blocks;

storage means for storing said divided pixel blocks;

determination means for determining an order of reading and/or writing of said pixel blocks from/to said storage means, based on the value regarding said relative angle detected by said detection means; and control means for performing the reading and/or writing of said pixel blocks from/to said storage means in the order determined by said determination means.

2. The printing apparatus according to claim 1, having plural printheads, wherein the respective printheads use different color printing materials to perform color printing.

3. The printing apparatus according to claim 2, wherein said storage means is shared among said plural printheads.

4. The printing apparatus according to claim 1, wherein said detection means comprises plural readers arrayed along said transfer direction of said print medium, and reads image data corresponding to one raster printed by said printhead by the respective readers to detect the value regarding said relative angle.

5. The printing apparatus according to claim 1, wherein said division means includes compression means for compressing the image data, and wherein said control means includes expansion means for expanding the compressed image data.

6. The printing apparatus according to claim 1, wherein said printhead is an ink-jet printhead which performs printing by discharging ink.

7. The printing apparatus according to claim 6, wherein said printhead discharges the ink by utilizing thermal energy, and includes thermal energy transducers for generating the thermal energy to be applied to the ink.

8. An image data processing method for a printing apparatus which performs printing by using a full-line type printhead having a printing area corresponding to a width of a printing area of a print medium, comprising:

a detection step of detecting a value regarding a relative angle of said printhead to a transfer direction of said print medium;

a division step of dividing image data, received in raster format, into plural pixel blocks;

a storage step of storing said divided pixel blocks into storage means;

a determination step of determining an order of reading and/or writing of said pixel blocks from/to said storage means, based on the value regarding said relative angle detected in said detection step; and a control step of performing the reading and/or writing of said pixel blocks from/to said storage means in the order determined in said determination step.

9. The image data processing method according to claim 8, wherein said printing apparatus has plural printheads, and when the respective printheads use different color printing materials to perform color printing, performs said detection step, said division step, said storage step, said determination step and said control step for each printhead.

10. The image data processing method according to claim 9, wherein said storage means is shared among said plural printheads.

11. The image data processing method according to claim 8, wherein in said detection step, image data corresponding to one raster printed by said printhead is read by plural readers along said transfer direction of said print medium, so as to detect the value regarding said relative angle.

12. The image data processing method according to claim 8, wherein said division step includes a compression step of compressing the image data, and wherein said control step includes an expansion step of expanding the compressed image data.

13. A storage medium having program code of an image data processing method for a printing apparatus which performs printing by using a full-line type printhead having a printing area corresponding to a width of a printing area of a print medium, said image data processing method comprising:

a detection step of detecting a value regarding a relative angle of said printhead to a transfer direction of said print medium;

a division step of dividing image data, received in raster format, into plural pixel blocks;

a storage step of storing said divided pixel blocks into storage means;

a determination step of determining an order of reading and/or writing of said pixel blocks from/to said storage means, based on the value regarding said relative angle detected in said detection step; and a control step of performing the reading and/or writing of said pixel blocks from/to said storage means in the order determined in said determination step.

* * * * *

UNITED STATES PATENT AND TRADEMARK OFFICE

CERTIFICATE OF CORRECTION

PATENT NO. : 6,609,845 B1
DATED : August 26, 2003
INVENTOR(S) : Ninomiya

It is certified that error appears in the above-identified patent and that said Letters Patent is hereby corrected as shown below:

Title page,
Item [56], References Cited, U.S. PATENT DOCUMENTS, "Bernegger et al." should read -- Bradshaw et al. --.

Signed and Sealed this

Thirtieth Day of March, 2004

JON W. DUDAS
*Acting Director of the United States Patent and Trademark Office*